US009662268B2

(12) United States Patent
Eddington

(10) Patent No.: US 9,662,268 B2
(45) Date of Patent: May 30, 2017

(54) SPAS AND BATHING SYSTEMS WITH ADVANCED INTERCHANGEABLE JET MODULES

(71) Applicant: Richard Alex Eddington, South Jordan, UT (US)

(72) Inventor: Richard Alex Eddington, South Jordan, UT (US)

( * ) Notice: Subject to any disclaimer, the term of this patent is extended or adjusted under 35 U.S.C. 154(b) by 150 days.

(21) Appl. No.: 14/072,780

(22) Filed: Nov. 5, 2013

(65) Prior Publication Data

US 2014/0131472 A1 May 15, 2014

Related U.S. Application Data

(60) Provisional application No. 61/722,776, filed on Nov. 5, 2012.

(51) Int. Cl.

| | |
|---|---|
| ***A61H 33/00*** | (2006.01) |
| ***B05B 17/08*** | (2006.01) |
| ***A61H 33/02*** | (2006.01) |

(52) U.S. Cl.

CPC ..... *A61H 33/6063* (2013.01); *A61H 33/027* (2013.01); *A61H 33/6005* (2013.01); *B05B 17/08* (2013.01); *A61H 2201/1685* (2013.01)

(58) Field of Classification Search

CPC .. A61H 33/025; A61H 33/026; A61H 33/027; A61H 33/6036; A61H 33/6005

USPC ..... 4/541.1–541.6

See application file for complete search history.

(56) References Cited

U.S. PATENT DOCUMENTS

| | | | | | |
|---|---|---|---|---|---|
| 3,742,521 | A * | 7/1973 | Bolgert | A61H 33/60 | 261/71 |
| 3,986,217 | A * | 10/1976 | Doerr | A47K 3/10 | 4/541.4 |
| 4,290,982 | A * | 9/1981 | Bauman | A61H 33/025 | 239/555 |
| 4,414,695 | A * | 11/1983 | Hart | A61H 33/027 | 261/88 |
| 4,458,676 | A * | 7/1984 | Pileggi | A46B 13/06 | 15/22.1 |
| 4,671,463 | A * | 6/1987 | Moreland | A61H 33/027 | 239/428.5 |
| 5,754,989 | A * | 5/1998 | Ludlow | A61H 33/0087 | 4/541.1 |
| 5,987,663 | A * | 11/1999 | Ludlow | A61H 33/027 | 4/541.1 |
| 6,000,073 | A * | 12/1999 | Eddington | A61H 33/0087 | 4/541.1 |
| 6,543,067 | B2 * | 4/2003 | Eddington | A61H 33/6068 | 285/3 |

(Continued)

FOREIGN PATENT DOCUMENTS

| | | | | |
|---|---|---|---|---|
| EP | 0209646 A2 * | 1/1987 | | A61H 33/026 |
| GB | 2224203 A * | 5/1990 | | A61H 33/02 |

(Continued)

*Primary Examiner* — Erin Deery

(74) *Attorney, Agent, or Firm* — Amy Fiene; James Sonntag

(57) ABSTRACT

A bathing system with a molded shell has hollows in the shell. A module with internal water and air chambers is installed in each hollow with jets mounted upon the front jet plate of the module. The module is of simple construction that is mounted in a hollow and is removable and interchangeable for easy upgrading and repair of the bathing system.

19 Claims, 29 Drawing Sheets

(56) References Cited

U.S. PATENT DOCUMENTS

| | | | | |
|---|---|---|---|---|
| 7,908,684 | B2 * | 3/2011 | Ludlow | A61H 33/02 4/584 |
| 7,950,077 | B2 * | 5/2011 | Santamarina | A61H 33/6063 4/541.6 |
| 8,661,576 | B2 * | 3/2014 | Ludlow | A61H 33/02 4/541.1 |
| 8,756,723 | B2 * | 6/2014 | Loyd | B05B 1/3026 4/541.6 |
| 2009/0288247 | A1 * | 11/2009 | Nguyen | A61H 33/027 4/541.6 |

FOREIGN PATENT DOCUMENTS

| | | | | |
|---|---|---|---|---|
| WO | WO 2006046939 | A1 * | 5/2006 | A61H 33/02 |
| WO | WO 2014071422 | A1 * | 5/2014 | A61H 33/6063 |

* cited by examiner

Fig. 7
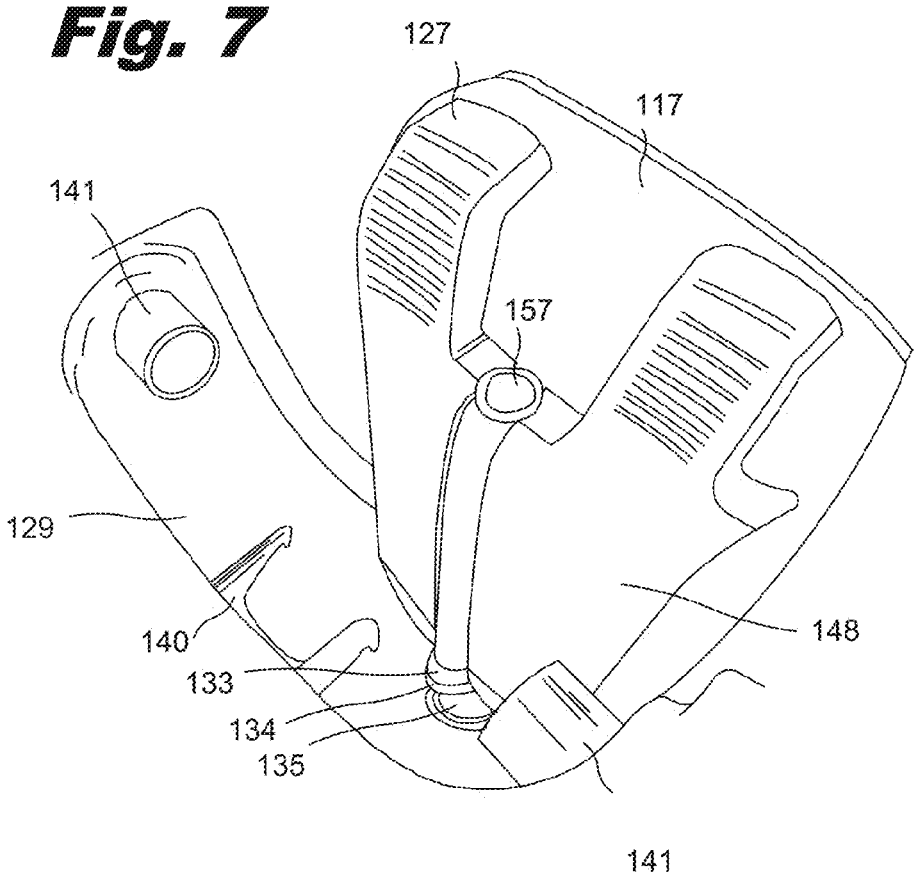
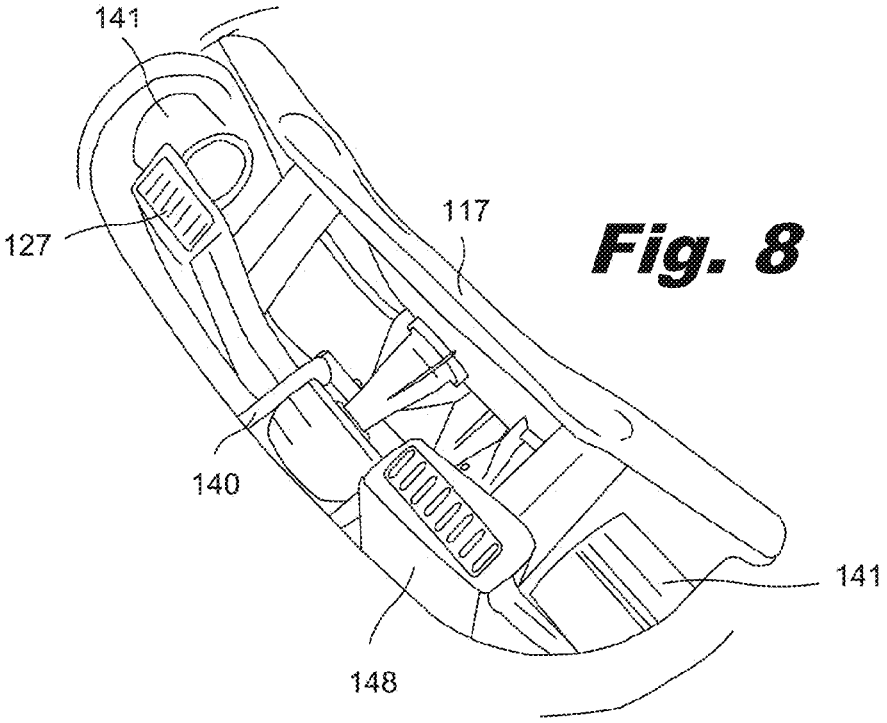
Fig. 8

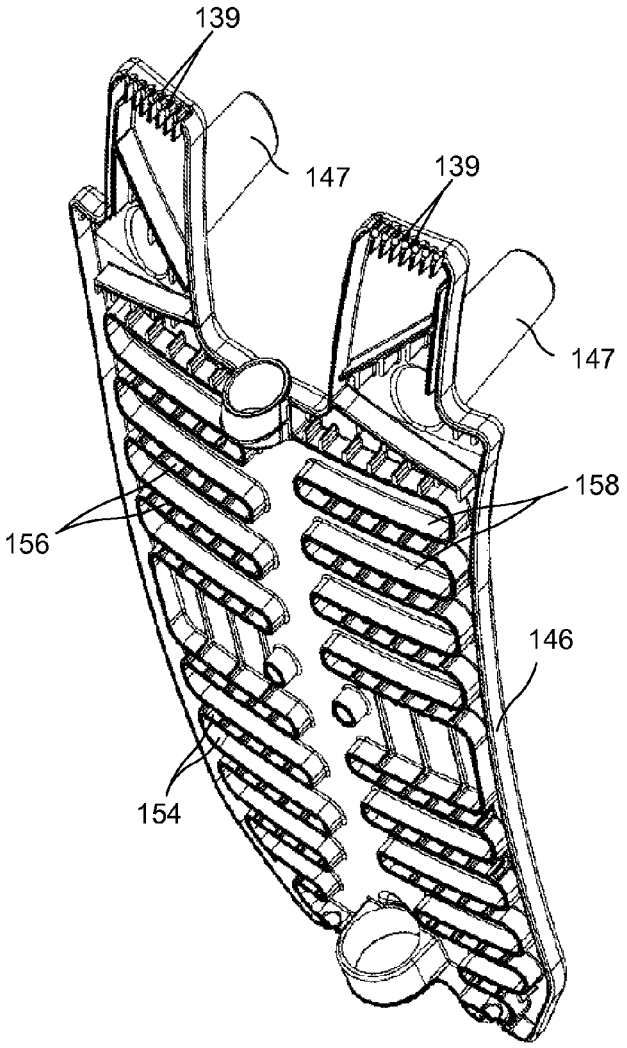
Fig. 13
Fig. 14
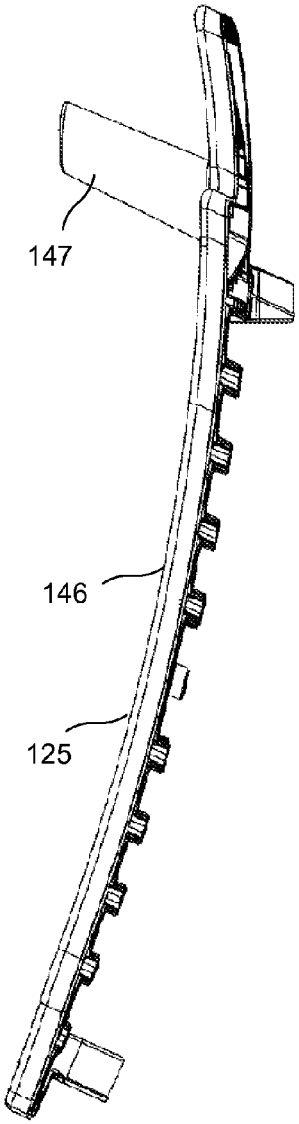

SPAS AND BATHING SYSTEMS WITH ADVANCED INTERCHANGEABLE JET MODULES

BACKGROUND OF INVENTION

An advance in the construction of spas has been the development of modular construction systems that allow for easier upgrading and repair of water jet systems in a spa. These modular systems are disclosed in U.S. Pat. No. 5,754,989, issued 26 May 1998, titled "PLUMBING AND SHELL SYSTEM FOR SPA"; U.S. Pat. No. 6,092,246, issued 25 Jul. 2000, titled "PLUMBING AND SHELL SYSTEM FOR SPA"; U.S. Pat. No. 6,000,073, issued 14 Dec. 1999, titled "JET ZONE DISTRIBUTION SYSTEM FOR SPAS"; U.S. Pat. No. 5,987,663, issued 23 Nov. 1999, "MODULAR SYSTEM FOR SPAS AND BATHING SYSTEMS"; U.S. Pat. No. 6,256,805, issued 1 Jul. 2001, titled "MODULAR SYSTEM FOR SPAS AND BATHING SYSTEMS"; U.S. Pat. No. 6,543,067, issued 8 Apr. 2003, titled "INTEGRATED MANIFOLD SYSTEM FOR SPAS"; and U.S. Pat. No. 7,908,684, issued 22 Mar. 2007, titled SPAS AND BATHING SYSTEMS WITH UPGRADEABLE AND INTERCHANGEABLE JET STATIONS" (Ludlow system). These patents provide background, and are hereby incorporated by reference.

In modular systems, a shell, or spa containment, is constructed with depressions or hollows in a shell wall. Each of the hollows is fitted with a module that comprises a plate for the hollow upon which are mounted jets for injecting water into the spa shell. One or more water inlets extends through the shell to provide water for the jets. The water inlets may communicate water from a water supply. Also, air is supplied to the module from an air inlet and air supply. The flow of air and water through the jets, in isolation or combination, may be controlled to provide the user with a desired flow rate and corresponding sensation.

With this construction, using one or more standard hollow designs, the bathing system can be upgraded or repaired with new jets by an easy hand replacement of the module with a new one having the same or different jets.

While prior-art modular spa systems have many advantages, there may be found some difficulties. For example, the supply lines or tubing located behind the plate and that deliver water and air to the jets are susceptible to residual buildup on the supply lines or tubing from stagnant water and chemicals, the supply lines or tubing therefore requiring cleaning and eventual replacement. Furthermore, the tubing may be interwoven, therefore requiring time to separate the tubing. Such a configuration makes tubing cleanup, repair, and replacement more difficult.

A construction that provides the advantages of a modular spa but with enhanced water and air delivery would be an advance in the art.

SUMMARY OF INVENTION

Embodiments provided herein may be used in a bathing environment, such as a bath, shower, or spa environment.

Embodiments may include a removable jet module comprising a manifold with an array of air and water chambers within the manifold, a water port that communicates water from a water supply to the water chambers, an air port that communicates air from an air supply to the air chambers, at least one jet attached to the jet panel that communicates the water from the array of water chambers and the air from the array of air chambers to an environment outside of the jet panel.

Embodiments may include a manifold in a removable jet module that comprise an array of air chambers and water chambers and a jet mounting surface for mounting jets. The array of chambers relative to the mounting surface is configured to provide adjacent water and air supplies for any individual jet mounted on the surface. This allows the jet to be mounted essentially anywhere on the mounting surface by making adjacent water supply and air supply holes into the manifold to access respectively water and air chambers.

The jets are constructed with spaced air and water inlets for mounting on the surface. The spacing of the jet water and air inlets, and the air and water chambers are dimensioned and configured such that air chambers and water chambers are accessible to the respective jet inlets at most or all positions on the mounting surface.

The array of water chambers and air chambers is constructed to provide close proximity of water and air supplies for any potential position for jet mounting on the jet mounting surface. This can be provided by any suitable arrangement, including any one or a combination of branched systems, systems with adjacent straight or curved conduits, intertwined conduits, double spirals, and the like. The air and water supply systems are designed to supply respectively air and water to all parts and branches of the air and water chambers. This can be provided by conduits that extend horizontally or vertically the entire width or length of the manifold, such as that illustrated in the examples, where air and water conduits extend the length of the manifold. Water or air can also be conveyed by bridging conduits, such as, for example, a water conduit bridging under an air chamber to supply water to a portion of the water chamber on the other side of the air chamber.

Minor adjustments of position may be required along the surface (on the order to a few centimeters or less) to ensure water and air supplies, but these adjustments are not regarded as consequential in the overall design of the jet configuration. Basically, using the same manifold and jet plate, different modules can be easily constructed with little or no limitation to jet type, jet size, and jet arrangement.

Jets may be constructed with variable spacing between the water and air inlets to further increase the flexibility of jet positioning. In the examples below, the jet nozzle is on the same axis as the water inlet. However, jets may also be constructed with the jet nozzle on the same axis as the air inlet, or have both inlets and the nozzle offset and on different axes.

BRIEF DESCRIPTION OF DRAWINGS

FIG. 7 is a perspective view of a module that is unattached to a hollow.

FIG. 8 is a perspective view of a module that is attached to a hollow.

FIG. 13 is a perspective cutout view of a top section of a manifold.

FIG. 14 is a side cutout view of a top section of a manifold.

DETAILED DESCRIPTION

Figure 1:
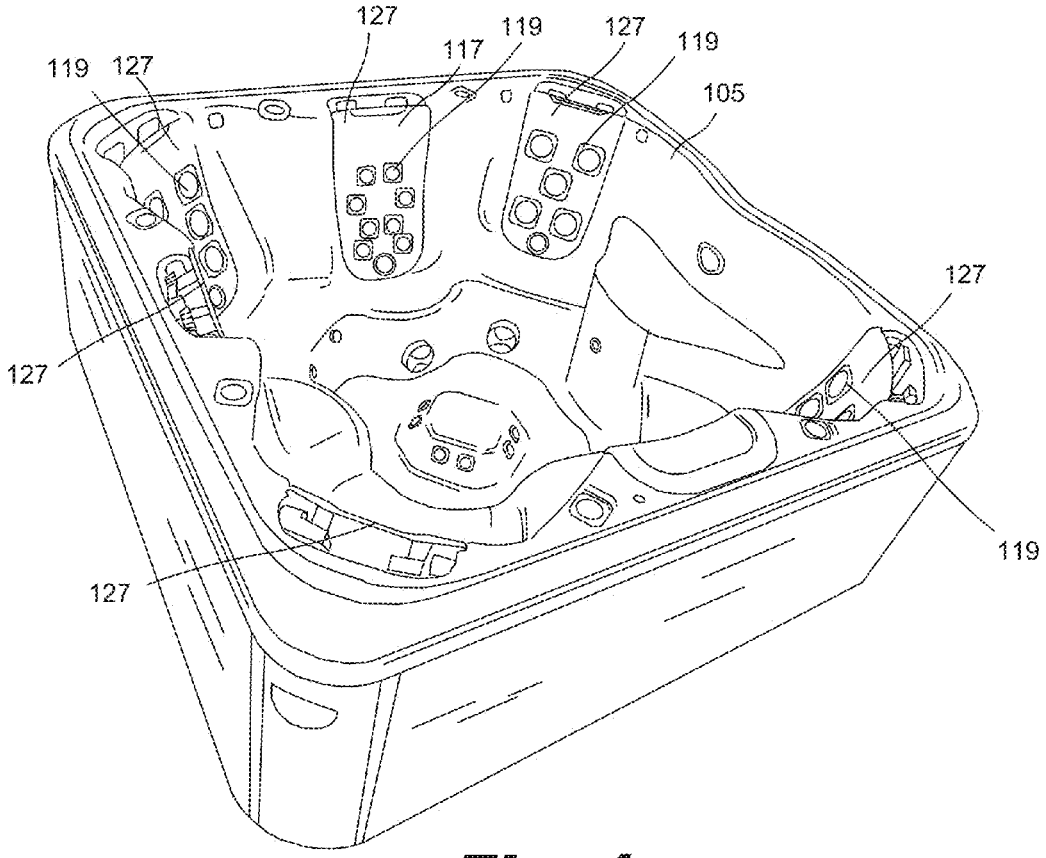
FIG. 1 is a perspective view of an interchangeable modular system for a spa environment.
Figure 2:
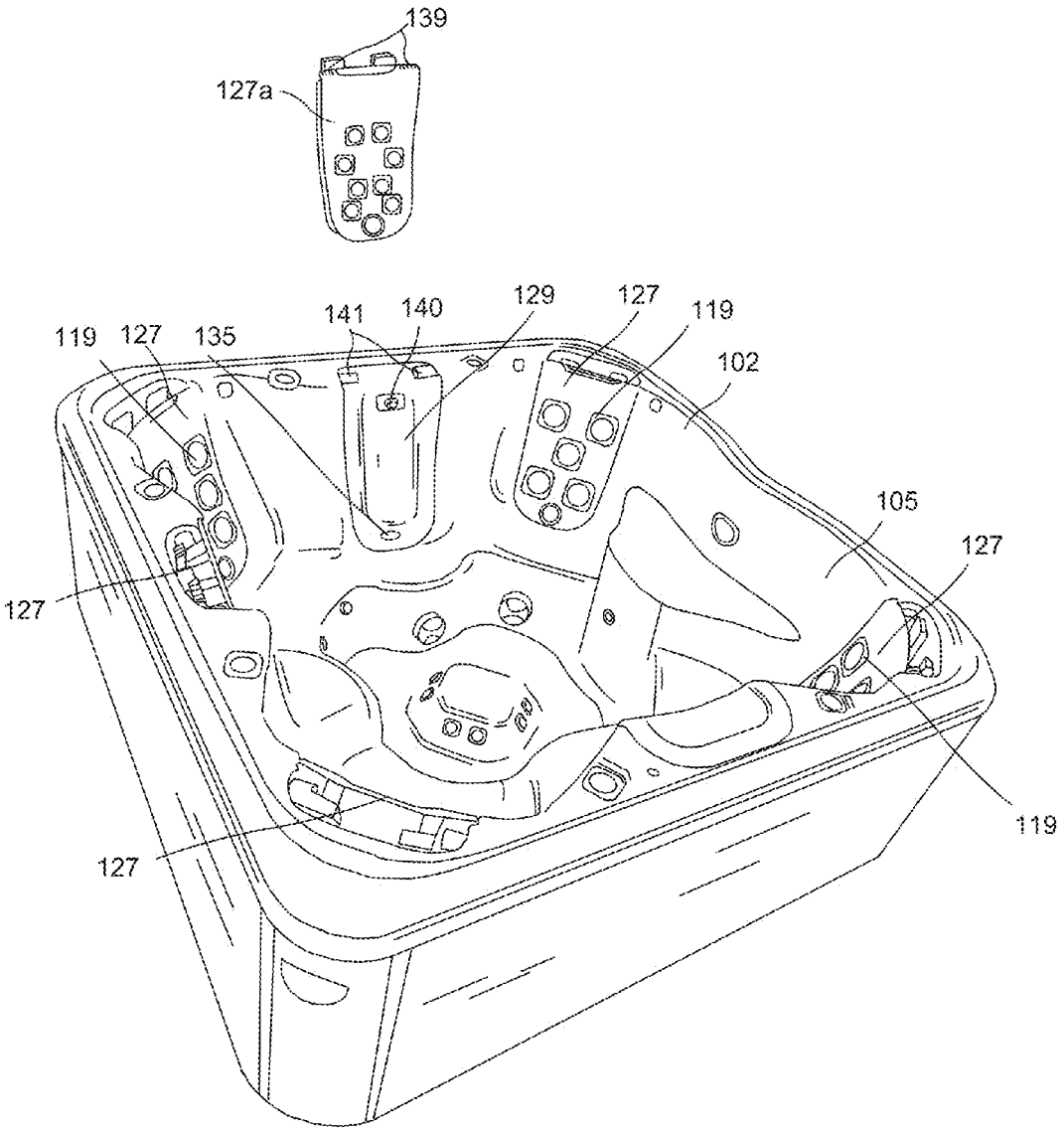
FIG. 2 is a perspective view of FIG. 1, with a module removed from a hollow.

The following addresses removable and replaceable jet stations that include enhanced delivery means of water and air for a bathing and spa environment. Referring to FIG. 1, an exemplary modular spa is shown that includes a containment 105; interchangeable jet modules 127; jet plates 117; and jets 119. A similar drawing is shown in FIG. 2, however, selected interchangeable modules are removed, and reference is made to further elements that include hollows 129, a locking structure which is a latch 140, shoulders 141, and water ports 135.

With the modular spa construction as shown in FIG. 1, jet modules 127, each with mounted jets 119, direct water and air into the containment 105. Each jet module 127 further includes jet plates 117, which provide stability for the jets 119 and which also provide resting surfaces that may be generally continuous or flush with the surface of the containment 105.

The modules 127 fit within the hollows 129. As shown, a spa may have multiple occurrences of hollows and one or more different types of hollow locations. For example, configurations may include hollow locations at the corners and sides of a spa. Hollow locations may also be at a typical feet region, leg region, or another targeted body region. Also, hollows can be designed to contain one or more modules of suitable configuration. The modules designed to fit a single hollow design can differ from each other not only in jet configuration, but also, for example, in external contour (e.g. head rest) and texture.

Note that in addition to spa environments, jet modules may be incorporated into a shower or other bathing environment. Also, jet modules may be interchangeable between spas and bathing environments. Alternatively, modules may be unique to one or more particular hollows or to one or more spas and spa environments.

With the module 127*a* removed in FIG. 2, the latch 140, shoulders 141, and water port 135 are visible in the hollow 129. The latch includes an elongated member that extends from the hollow 129 and curves downward such that it may be used to secure the modules 127 and 127*a* to the hollow 129. The shoulders 141 include pipe sections located in the upper region of the hollow and that extend from the sides of the hollow 129 and that are used to support a cover (not shown in FIG. 2) over the module 127. The water connector 133 (not shown in FIG. 2) includes a conduit on the module 127 that connects with the water port 135. Air is provided to the modules 127 and 127*a* via air ports 139, each air port 139 comprising one or more orifices on top of modules 127 and 127*a*.

Instead of a separate air and water port, it is also contemplated that the hollow and its corresponding module be equipped with a single combination air and water connector and combination air and water port. Thus, water and air would be delivered as a unit to each module 127 and 127*a*.

Figure 3:
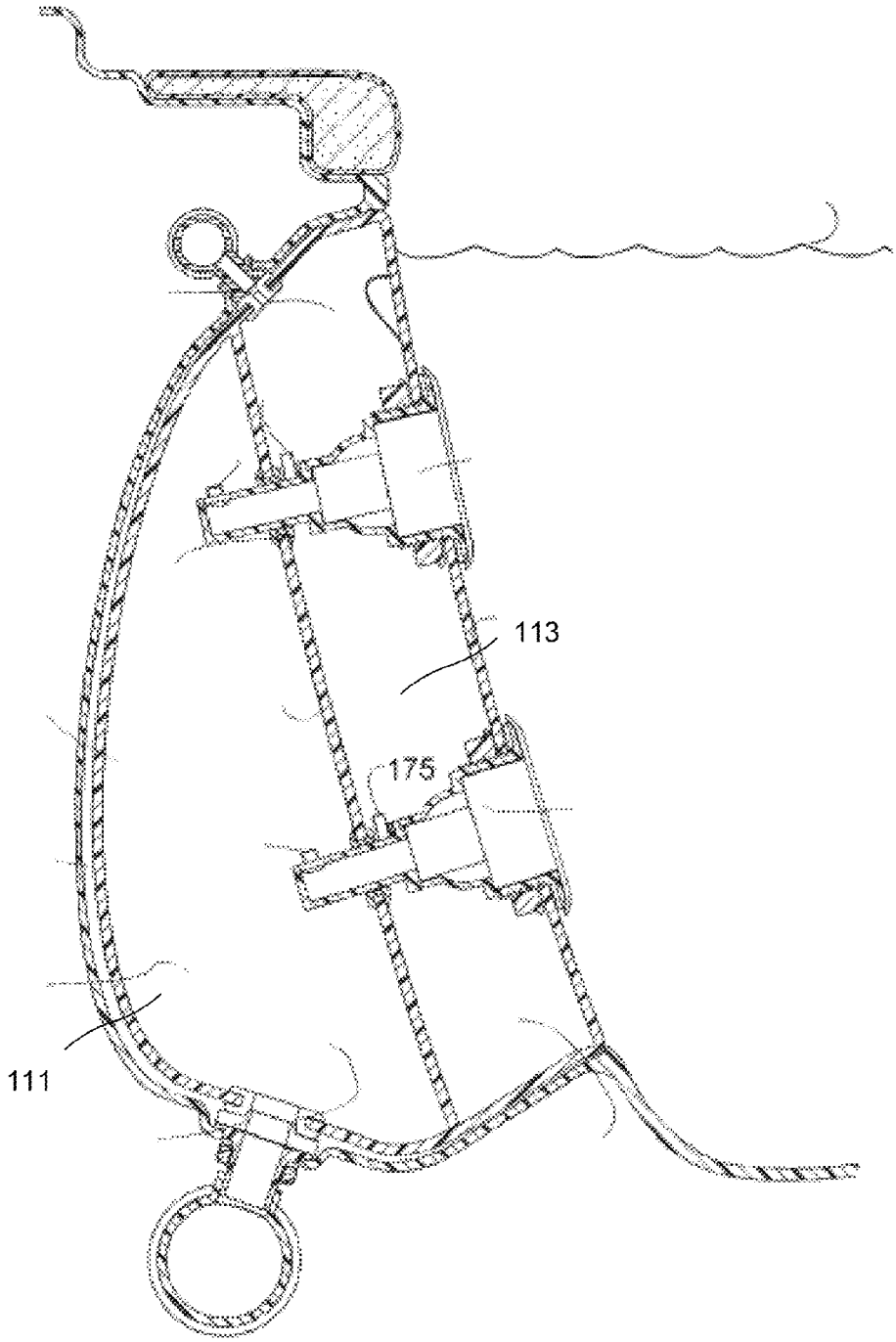
Fig. 3 PRIOR ART
FIG. 3 is a side cutout view of a prior-art canister A.
Figure 4:
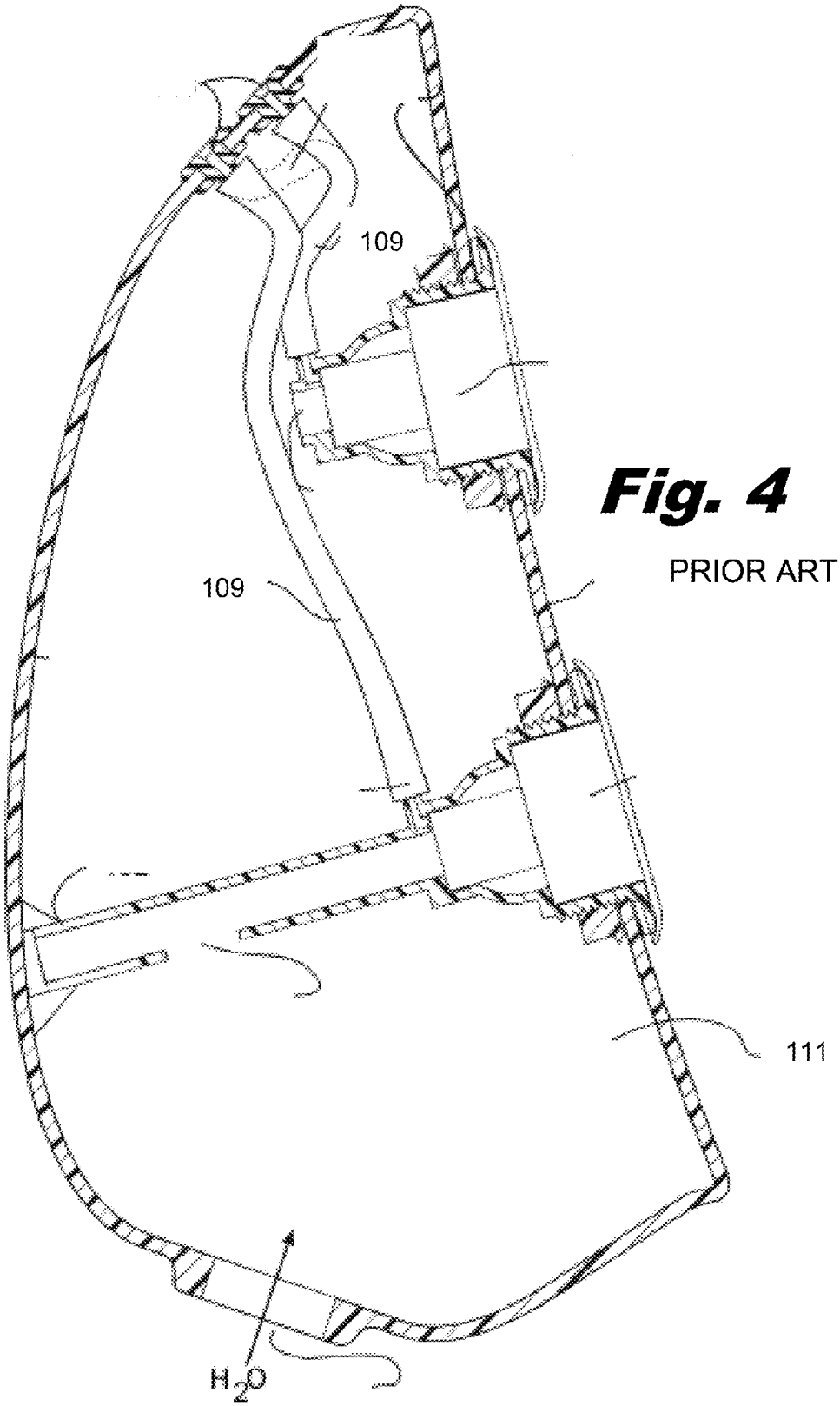
Fig. 4 PRIOR ART
FIG. 4 is a side cutout view of a prior-art canister B.

In prior art spa systems, such as the above Ludlow system, with interchangeable canister construction and a single water feed and air feed, a canister can be prone to problems. For example, a module may have an internal water distribution system that results in uneven flow through the jets. As shown in FIG. 3, a water distribution system may comprise air chamber 113 and water chamber 111 that connect to the jets. FIG. 4 further includes the use of air conduits 109 and water chamber 111 to the jets. There could also be a water conduit in the system. Unfortunately, both systems allow water and air to exhibit vortex behavior within the canister, which yields uneven flow through the jets, ultimately causing discomfort to the user. For example, a vortex in the upper chamber or in one of the conduits may disrupt water flow in the upper chamber and prevent otherwise smooth, laminar flow to an upper jet, such that the flow to the upper jet is less than the flow going to the rest of the jets on the canister.

To reduce the onset of vortex behavior, certain flow rates may have to be used instead of flow rates that would be more soothing to the user. Flow rates that eliminate the problem of vortex behavior, however, may be difficult to obtain and be time-consuming to find. Also, flow rates that eliminate the problem may change over time, requiring a fine-tune adjustment.

Besides flow problems, chambers and conduits are also susceptible to residual buildup that commonly results from stagnant water over time. The buildup may be difficult to clean or otherwise remove. Also, the buildup may cause permanent damage to the modules and jets. Furthermore, buildup that comes off the interior surfaces of the module during spa use may be passed into the spa shell, tainting the spa water. Thus, the systems shown in FIG. 3 and FIG. 4 may not be desirable in some respects for a user.

Figure 6:
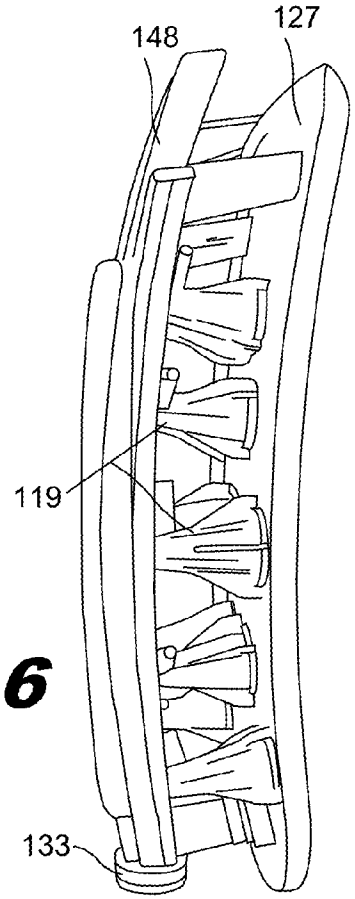
FIG. 6 is a side view of a module.
Figure 5:
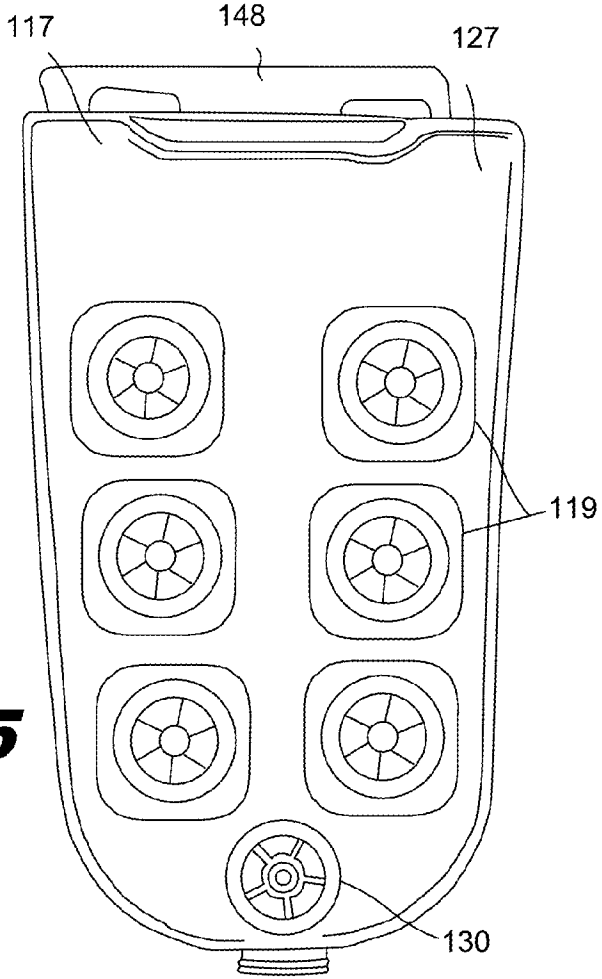
FIG. 5 is a front view of a module.

With a jet module 127 as shown in FIGS. 5 and 6, these problems may be reduced or eliminated completely. Further advantages may also be readily apparent. The jet module 127 comprises a plate 117, attached jets 119, jet valve 130, water connector 133, and manifold 148.

Like the Ludlow interchangeable modular spas, the jet module 127 may be attached and removed from the hollow of the spa with an easy and simple hand maneuver. However, the module 127 has several advantages over the Ludlow counterparts. First, the manifold 148 may include a generally thin member that comprises internal conduits or pathways that are also generally thin. Thus, less water may collect within the conduits or pathways. Such a configuration does not require as much material, is lightweight, and is not as bulky as previous jet canisters. Such a structure also prevents vortices and other disruptions on what would otherwise be a smooth or laminar flow. The manifold 148, and the module 127 as a whole, is thus lighter and easier to manipulate. While the jets are sandwiched between the manifold 148 and plate 117, they remain exposed, and are not enclosed within a canister. Thus, the jets may be routinely examined and also examined any time a jet problem occurs. Also, a jet may be adjusted if needed. Other advantages are also anticipated from this configuration.

A second advantage is apparent from the installation of the module 127. FIG. 7 shows a hollow 129, a module 127, manifold 148, a water connector 133, a water port 135, O-ring 134, latch 140, and shoulders 141. As shown, the water connector 133 of the module 127 is being inserted into the water port 135 of the hollow 129. Water is supplied through the water port and water connector, into the manifold 148, and then into the jets. The O-ring 134 fits on to the end of the water port 135 and may be used to provide a solid seal between the water port 135 and water connector 133. The O-ring may be a single or multiple ring style. It may be made of rubber or other compressible materials to achieve a tight leak-proof fit.

FIG. 8 shows the module 127 in an installed position. After the water connector 133 is connected, the rest of the manifold 148 is pushed back into the hollow and slightly downward against the base of the spa, such that a locking structure, such as the latch 140, may go over the edges of the manifold 148 and secure the manifold 148 into the installed position. Similarly, when releasing the module 127, a downward push is exerted on the manifold 148, however, the manifold 148 is pushed out of the hollow. In this manner, a user may easily install and remove the module 127. It is envisioned that the user may be in the spa or out of the spa for these procedures.

In the installed position, the module 127 rests generally flush with the surface of the containment 105. This provides a generally uninterrupted surface in the spa. The latch 140 may be curved, squarish, rounded, or generally hooked in shape, to reach over the edges or surface on the outer edges of the manifold 148. As the jets 119 eject water and air, the latch 140 counteracts the resulting outward force on the manifold, maintaining the module 127 within the hollow.

Note that the installation features described herein may also find usefulness in a bath, shower, or another spa-like or bathing environment.

The shoulders 141 are rigid members that extend from the sides of the hollow 129 and are used for adjoining a protective cover 149 and water accessories to the module 127. Covers and accessories will be described more fully later in the specification.

Figure 9:
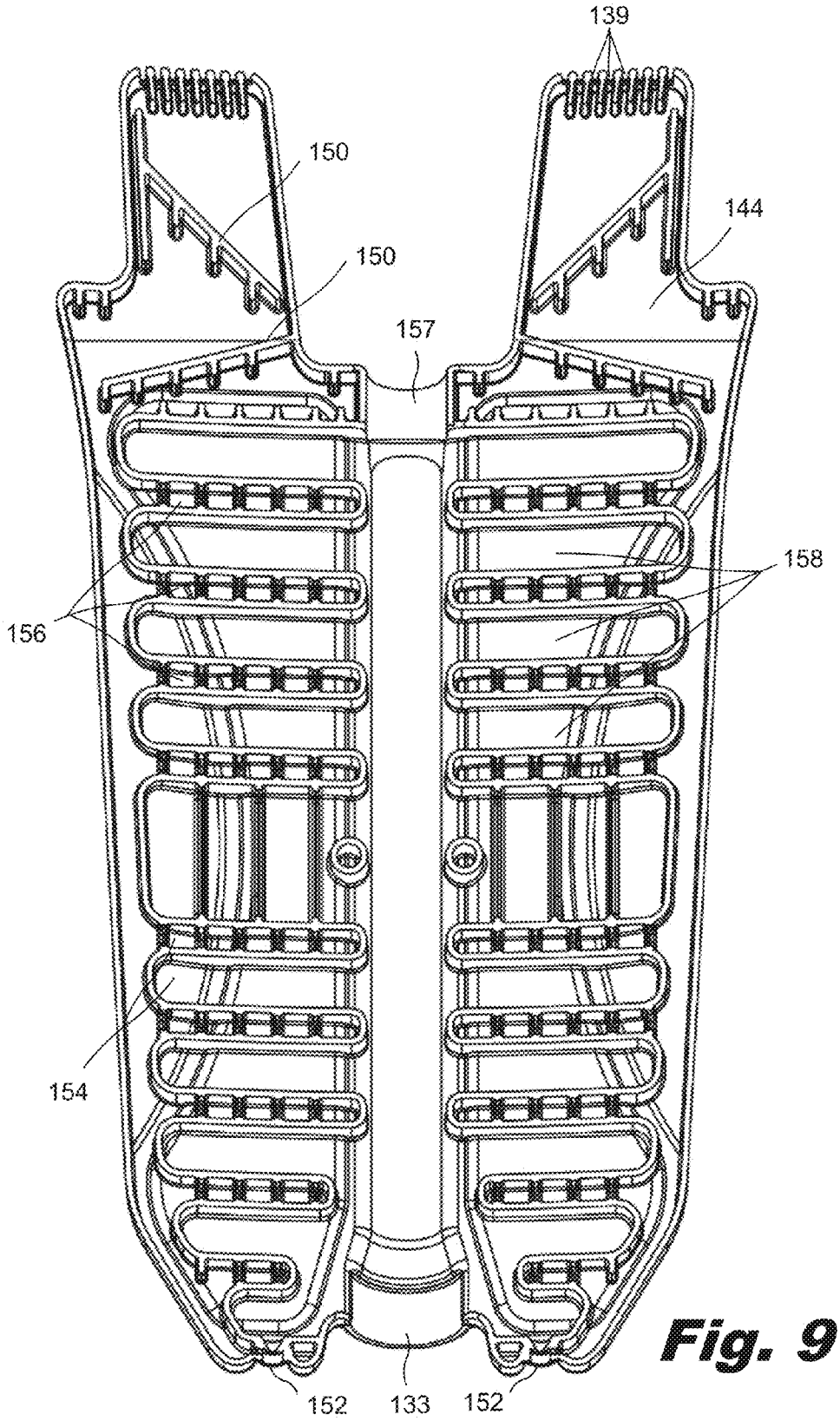
FIG. 9 is a front cutout view of a bottom section of a manifold.
Figure 10:
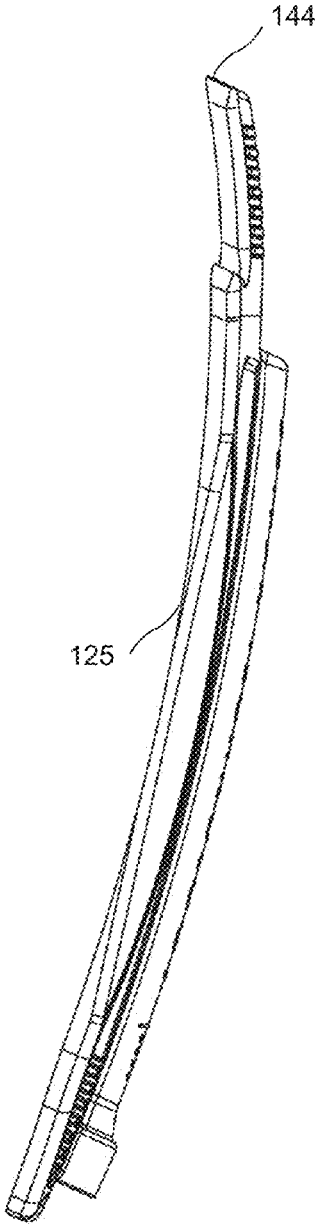
FIG. 10 is a side cutout view of a bottom section of a manifold.

The manifold 148 may be constructed by joining a top section and a bottom section. Turning to FIG. 9, a bottom section 144 is shown that includes the interior structure of the manifold 148. The interior structure includes a side-by-side array 154 of fluid (water and air) chambers, air baffles 150, venturi drain 152, air ports 139 and water connector 133. The top section of the manifold 148 (not shown in FIG. 9) which is connected or bonded to the bottom section 144 has a matching structure and when bonded with the top section forms a manifold with an internal structure as shown in FIG. 9. The top and bottom sections are similar, but may differ for external structures and be concave or convex curved, as shown in FIGS. 10 and 14, so that when bonded form a curved manifold as in FIG. 6. The internal structures, and bonding surfaces of the top and bottoms section are mirrored in each other. Accordingly, when bonded the internal structure of the manifold (along the curved cross-sectional plane of the bonded surfaces) is represented by the figures.

The side-by-side array 154 of chambers comprise chambers 156, 158, which function as separate fluid supplies for two fluids, air and water respectively. The chambers comprise finger-like air chambers 156 that extend from the sides of the manifold 144 toward the central region of the manifold 148. Interspersed between the air chambers 156 are water chambers 158 that extend from the central region of the manifold 148 toward the sides of the manifold. Water flows through the water connector, into the central region and into the water chambers 158. Air, on the other hand, flows through the air port 139, through the air baffles 150, then along the sides and into the air chambers 156. In this manner, air and water spread throughout the manifold 148.

The side-by-side array 154 of chambers may be manifest in various configurations. Embodiments include, for example, that the chambers be slanted downward, or in other words, that the chambers form a V-shape. This may be advantageous because water would naturally flow into the central region and through the water connector. Thus, the water chambers 158 would have a natural drying effect on the interior of the module 127. Many other different configurations are also envisioned. For example, chambers may be rounded with one or more curves. Also, the chambers may all point inward at a central point, rather than downward. Chambers may even be arranged in a circular arrangement, such that water and air are recycled through their one or more chambers.

Embodiments further include that the chambers 156, 158 of the array 154 not have air and water arrayed in a strictly side-by-side manner. For example, an array could include a pattern of multiple side-by-side chambers of air followed by multiple side-by-side chambers of water. Then, the pattern could repeat. Besides this example, embodiments include chambers with other different side-by-side patterns.

Figure 11:
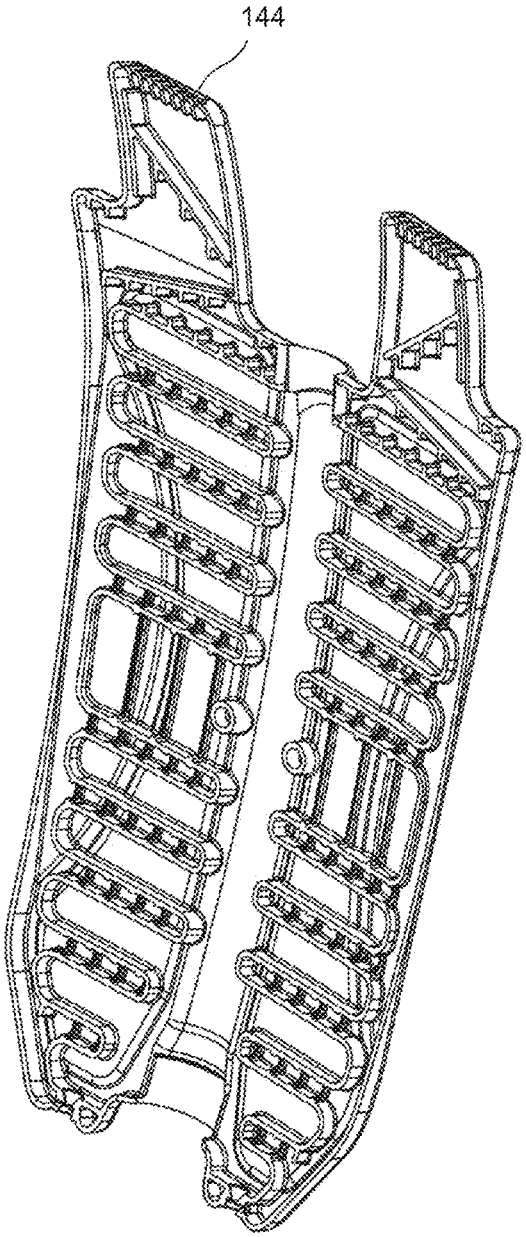
FIG. 11 is a perspective cutout view of a bottom section of a manifold.

FIGS. 10 and 11 show a side view and a perspective view, respectively, of the bottom section 144 of the manifold 148. The bottom section of the manifold 144 is curved or bent, to follow the contours of the module 127. Referring also to FIG. 6, the manifold is contoured in parallel with the jet plate 117. The top section 146 provides a jet mounting surface 125 for mounting of jets. Because of this parallel contouring between jet plate 117 and manifold 148, jets configured between the jet plate 117 and manifold 148 may all be the same length. This is true because jets of equal length provide a fixed width between jet plate 117 and manifold 144. This is advantageous, for example, because special manufacturing is not required for each jet. Rather, a given set of jets for one module can be made of equal length. Furthermore, replacement and repair can be streamlined for any set of jets. Jets of different diameters may be used for a given module, with ease, as long as they do not effect the length of the jet. Therefore, a user may purchase a module with jets of specifically sized-diameters to suit his or her needs and desires. Jets that are the same diameter may be interchangeable with each other. Other advantages may also be readily apparent to one of ordinary skill in the art.

Figure 12:
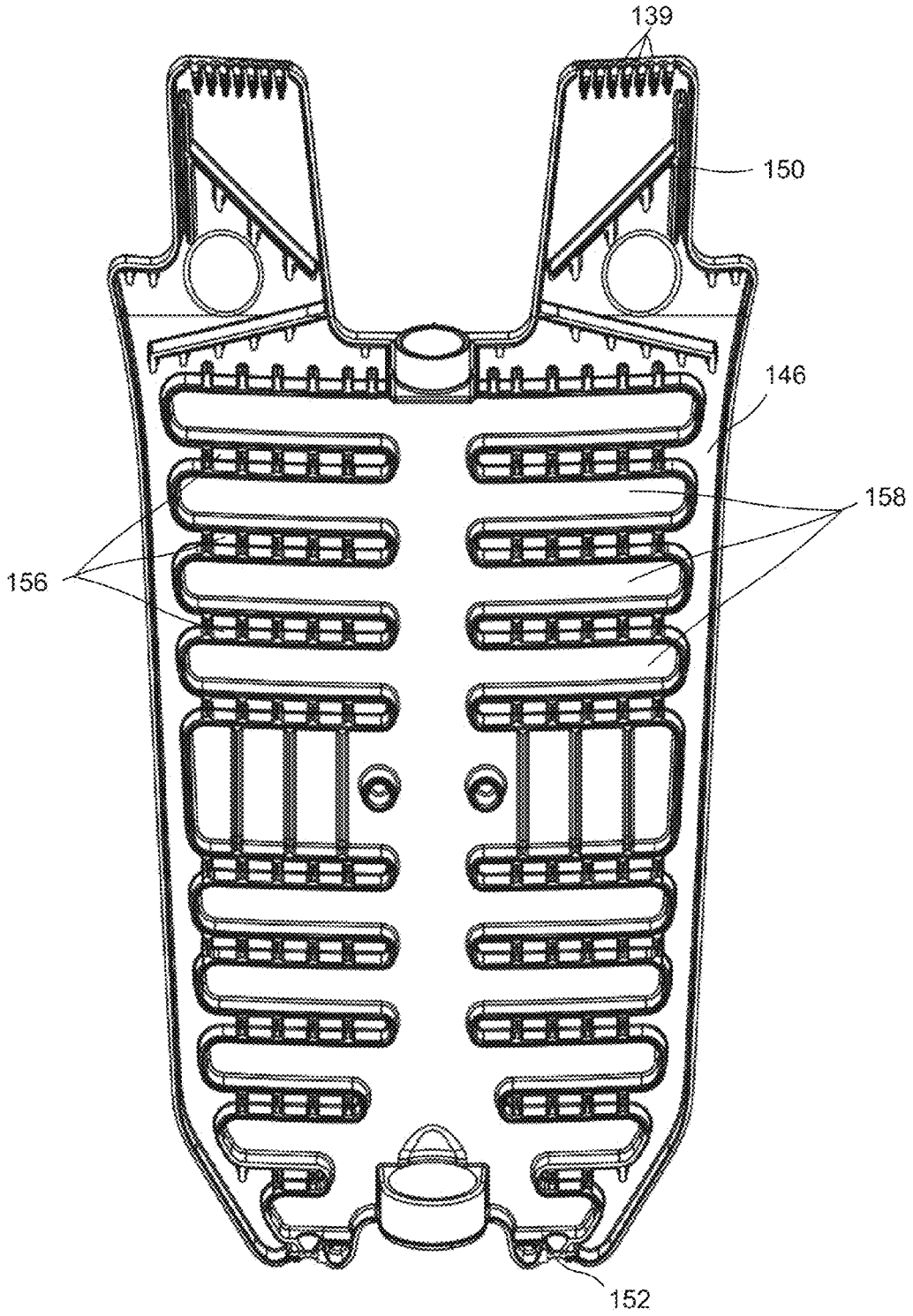
FIG. 12 is a front cutout view of a top section of a manifold.

Embodiments include that the array of water chambers and air chambers are formed by a set of ridges or wall structures the bottom section 144 aligned and joined with the ridges or wall structures on a top section 146 (see FIG. 12). The joined ridges and walls may also form other structures, such as air baffles 150 (see FIG. 34) and venturi drains 152 (see FIG. 33) described at a later section herein. A function of the top section is to provide a jet mounting surface with an underlying array of water and air chambers. A function of the bottom section is to close the air and water chambers and provide independent fluid continuity, respectively for the air chamber and the water chamber. Accordingly, embodiments include that the bottom section may not mirror, or only partially mirror the array in the top section, providing alternate conduits, bypasses, three dimensional conduit configurations to provide fluid continuity in the air chamber and in the water chamber. Thus, embodiments include that only the bottom section 144 or only the top section 146 have ridges or wall structures. In such embodiments, the section without ridges or wall structures serves to close off the ends of the ridges or wall structures to form the chambers.

Turning to FIG. 12, a top section 146 which is bonded to the bottom section 144, is shown. As explained above, the structure of top section 146 is mirrored in the bottom section 144 so that when bonded together, they become the manifold 148 with the internal structure shown. Since manifold structure may be mirrored in each section, each section may comprise a half part of the air port 139, a half part of each air chamber 156 and water chamber 158, a half part of each venturi drain 152, and a half part of each air baffle 150. Ultimately, the two sections put together may become the manifold 148.

To secure the two sections together, any suitable bonding system is contemplated. In a suitable system the sections may be friction welded, where the two sections are clamped together and then machine rubbed together vigorously. In such a manner, the material fibers enmesh such that the two sections are made inseparable, fully sealed, and leak-proof. Embodiments include other methods of securing the two sections together, such as any one or a combination of heat treatments, glues, bonding adhesives, snaps, and fasteners. Embodiments may further include that the two sections be joined such that the two sections may be separated and rejoined as needed. For example, joinder using an adhesive that is soluble may be used to allow a later separation.

FIGS. 13 and 14 show a perspective view and side view, respectively, of the top section 146 of the manifold 148. The top section 146 is contoured in the same way as the bottom section 144. In this way, the sides of the two sections are parallel and may be seamlessly secured together.

On the surface of the top section 146 and facing away from the bottom section 144, abutment members 147 extend radially outward from top section 144. The number of abutment members may be only one, or greater than two. The abutment members 147 are dimensioned to maintain the parallel distance between the manifold 148 and the jet plate 117. The abutment members 147, in addition to the jet, also help secure the plate 117 to the manifold 148. In the illustrated embodiment, the abutments 147 are placed near the top of the module, where there may not be any jets, and additional support is required. If sufficient attachment between the jet plate and the manifold can be provided solely by the jets, the abutments 147 may be deleted altogether.

Figure 15:
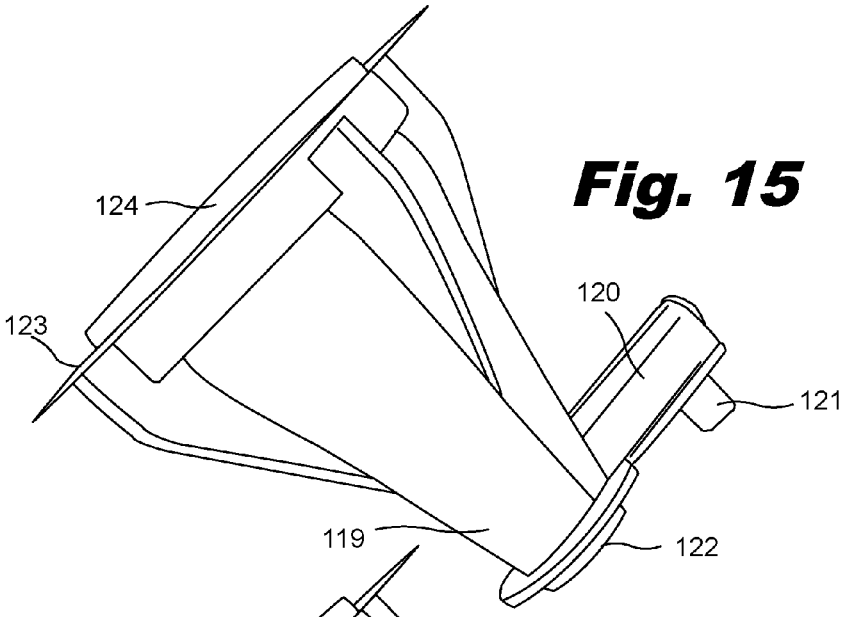
FIG. 15 and FIG. 15*a* are each a perspective view of a jet, a jet shield, and a jet plate.

Turning to FIG. 15, a perspective view of a jet 119, a jet shield 123, and a jet cover 124 is shown. The jet 119 includes a jet wing 120, a jet air intake insert 121, and a jet water intake 122. The outlet of the jet 119 may vary in various features, such as diameter and shape. In this manner, the jet flow may have a variety of bandwidths and contours. The jet shield 123 is a protective cover for the jet and is generally flat or slightly rounded to provide a smooth, continuous surface once it is fitted onto the jet plate. Thus, a user may have a smooth and comfortable resting surface. The jet shield 123 also protects the jet 119 from being jostled or loosened. The jet shield is attached to the jet and jet plate 117 by the jet cover 124, which comprises a round, threaded, hollow disc that screws into the jet 119, the process also securing the jet shield 123 and the jet plate 117 together.

Figure 15A:
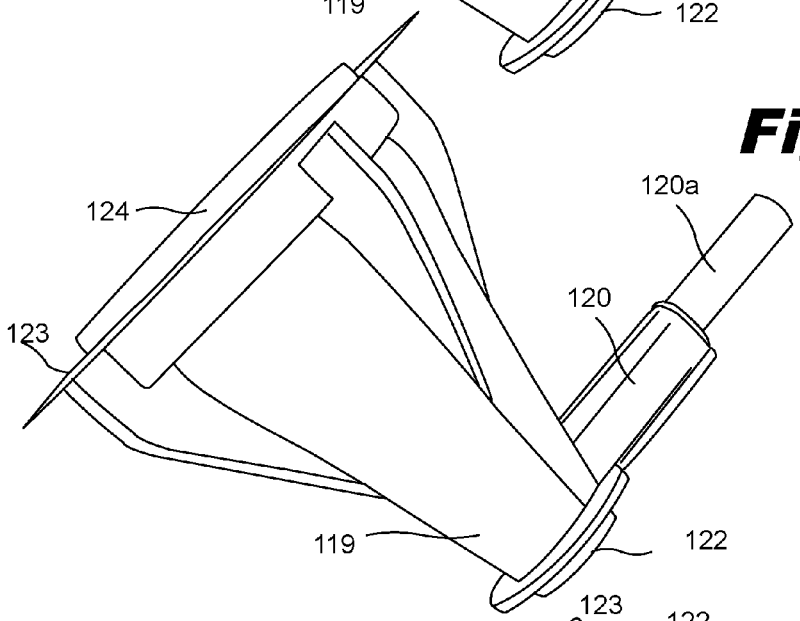

Water enters the jet 119 through a jet water intake 122, which is at the base of the jet along the axis of the jet. To receive air, the jet 119 includes the jet wing 120 and jet air intake insert 121. The jet wing 120 essentially comprises a radially extended hollow conduit member that is joined or fixed rigidly to the jet 119. On or near the end of the conduit, the jet air intake insert 121 is located. The jet air intake insert 121 is a conduit member that connects to the conduit of the jet wing 120 and that extends generally downward from the jet wing 120. On the end of the jet air intake insert 121 is a portal, or opening, in which air is received. The jet air intake insert 121, as shown, extends perpendicularly from the jet wing 120, however, the jet air intake insert 121 may be angled downward, or have curvature. The portal, or opening, of the jet air intake insert 121 may be rounded as shown, however, it may have another configuration. For example, the portal may be oval or rectangular, etc. FIG. 15*a* shows a perspective view wherein the jet wing 120 includes an inner hollow member 120*a* contained within the interior of the hollowed member and that may be extended to lengthen the jet wing.

To receive water, the jet 119 includes the jet water intake 122, a portal or opening located at the base of the jet 119.

Figure 16:
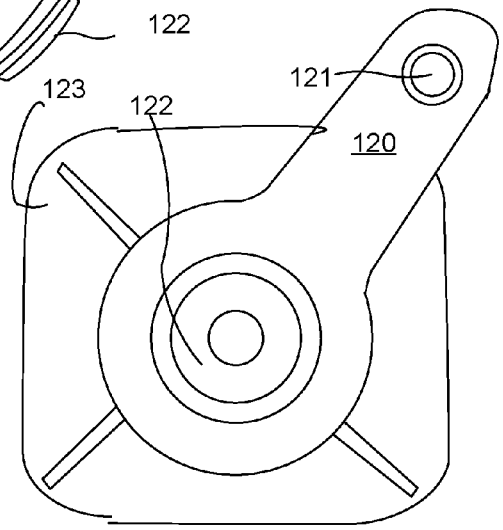
FIG. 16 is a bottom view of a jet.

FIG. 16 shows the base of the jet 119, which includes a jet water intake 122, the jet wing 120, and the jet air intake insert 121. Although shown at the base of the jet 119, the portal of the jet water intake 122 may also be located on the side of the jet or on the jet wing 120. Also, the jet water intake 122 may have a separate wing and a separate intake insert. In such a setup, the jet wing for water and jet wing for air may be movable relative to the jet 119, instead of being molded or otherwise connected to the jet 119. Alternatively, one of the wings may be movable while the other wing is rigidly fixed to the jet 119. Embodiments that include movable wings for water and air may be used, for example, to obtain various jet placement along the jet module 127.

Embodiments further include that wings have expansion capability, such that the wings may be lengthened or shortened, as needed. This may be accomplished, for example, by having a wing with a subwing contained within the wing, the subwing capable of being extended or retracted as needed or as desired. Also, subwings may be added by joining, bonding, or otherwise connecting to the wings.

Because the length of the wings and the movement of the wings relative to the jet 119 affect where the jet is placed on the module 127, and vice versa, jet placement and flow versatility may be increased by having various lengths of wings possible. The spacing between the water inlets and the air inlets of the jets may be designed in light of the spacing and configuration of the array of water and air chambers. The intent is to provide access to a water chamber and an air chamber at most points on the manifold surface for jet mounting. Exemplary spacing may be between, for example, between about 2 cm and about 10 cm, and more typically between about 4 cm and about 7 cm.

Figure 17:
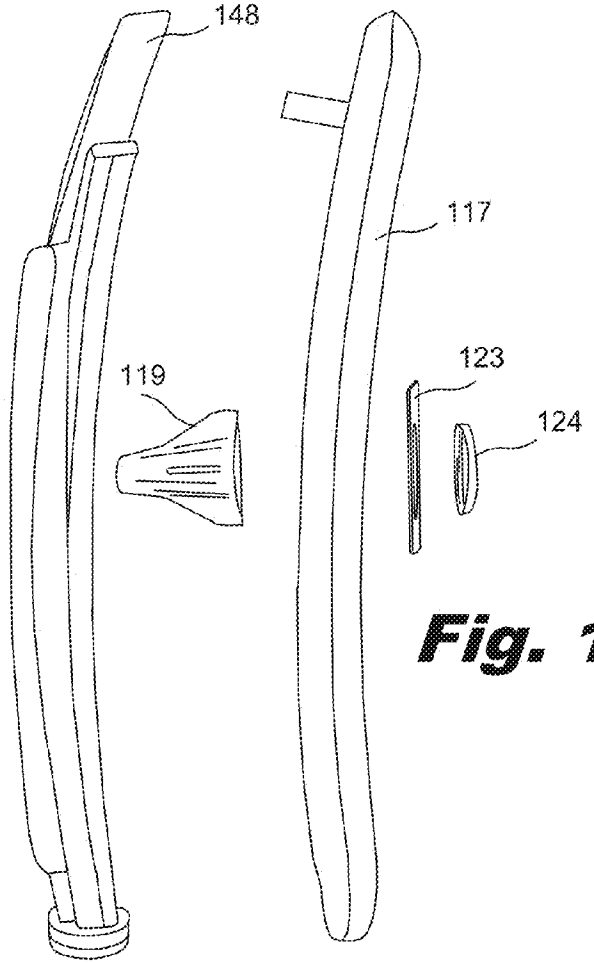
FIG. 17 is an exploded view of a jet attached to a manifold.

FIG. 17 depicts an exploded view of a jet assembly, including jet 119, jet plate 117, manifold 148, jet shield 123, and jet cover 124. In assembling the jet 119, the jet 119 may first be mounted to the manifold 148. This may be accomplished by drilling holes on the manifold 148. The locations of the holes may correspond with a desired location for water and air connections via the jet water intake 122 and the jet air intake insert 121. Once desired holes are drilled, the jet 119 may be bonded to the location via an adhesive, such as a cement or glue. Also, screws or other means of connection may be used. Holes for the jets 119 may also be drilled on the jet plate 117 such that the jet plate 117 and the manifold 148 may align when the jets 119 are mounted between them. Note that each jet 119 may require only a single hole on the jet plate 117—not multiple holes for water and air connections—given that the jet plate 117 serves to hold the outlet portion of the jet 119.

With the jet 119 mounted to the manifold 148 and the jet plate 117 positioned over each jet 119, the jet shield 123 may be fitted over the jet 119. The jet shield 123 may have an opening that conforms in size and dimension to the opening of the outlet of the jet 119 and the opening of the jet plate 117. Other shapes and dimensions are also anticipated.

The protective jet shield 123 may be made to fit tightly over the jet 119 and the jet plate 117 by mounting the jet cover 124. The jet cover 124 includes a threaded collar or ring that may be screwed into the hole of the jet plate 117, the hole of the jet plate 117 also being threaded. Instead of a screw fit, other types of mounting are also anticipated. With the jets mounted between the manifold 148 and jet plate 117, the jet assembly is complete.

To remove, replace, or repair one or more members of the jet assembly, the jet cover 124 may be unscrewed, the jet shield 123 and jet plate 117 removed, and the jet 119 unmounted from the manifold 148.

Figure 18:
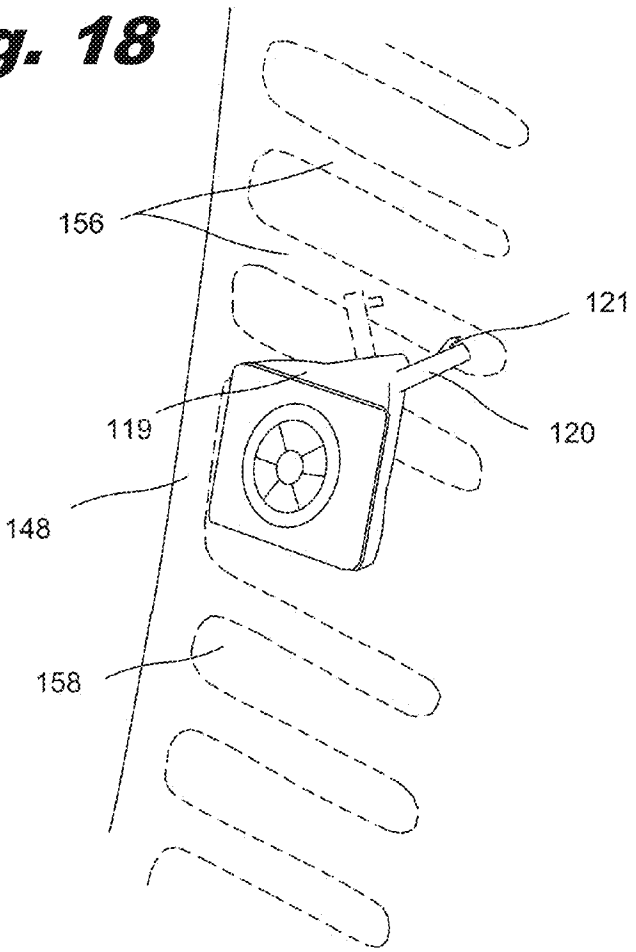
FIG. 18 is a perspective view of a jet attached to a manifold.

FIG. 18 suggests placement options for the jet 119. The jet may be moved vertically and horizontally on the jet mounting surface 125 to be joined to various water chambers 158 on the manifold 148. Because the jet 119 may rotate axially, the jet wing 120 may be rotated around the jet 119. This is advantageous because it allows strategic jet positioning. For example, the jet wing 120 may be placed near the central region or the outer sides of the manifold. Also, multiple jets may be placed next to each other and their respective jet wings may still have access to air chambers. Other advantages may be realized. In summary, there are many options for placement of the jet on the manifold 148.

As shown in FIG. 18, a first set of dotted lines in the figure delineate air chambers 156 and water chambers 158 located within the manifold 148. The jet 119 is placed on the jet mounting surface 125 of the manifold with the jet water intake 122 positioned over a water chamber 158. The jet air intake insert 121 is positioned over an air chamber. A second set of dotted lines represents a different placement option on the air chamber for the jet air intake insert 121. Many other placement options are also available by rotating the jet 119 along its longitudinal axis. For a given water chamber 158 position, the jets 119 may be rotated axially, allowing the jet air intake inserts 121 to be placed in multiple locations on the manifold 148.

Placement of the jet air intake inserts 121 are radially restricted by the length, or wingspan of the jet wings 120. If the jet wings 120 may be lengthened or shortened, even this limitation is removed. Thus, the position selection of air intake may comprise numerous locations on the manifold 148. This is advantageous because it allows placement of the jet air intake inserts 121 to correspond to a desirable location on the manifold 148. It also allows for fine tuning and adjustment that may be needed to create durable bonds between the jet air intake inserts 121 and corresponding air chambers 156.

Figure 19:
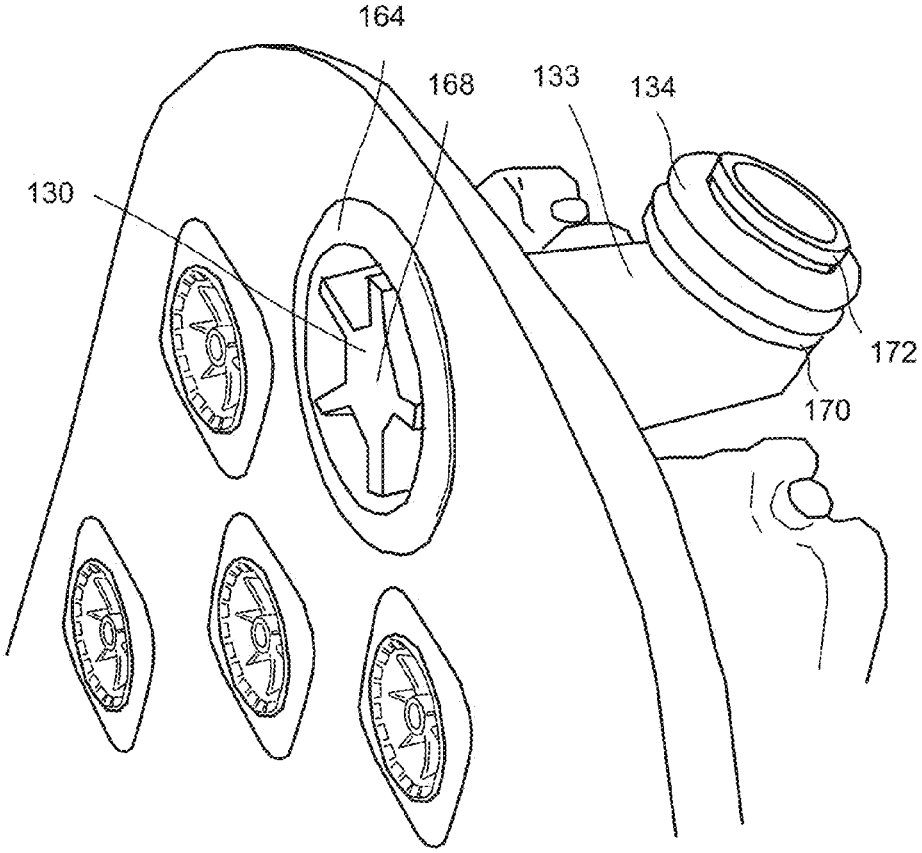
FIG. 19 is a perspective view of a valve.
Figure 20:
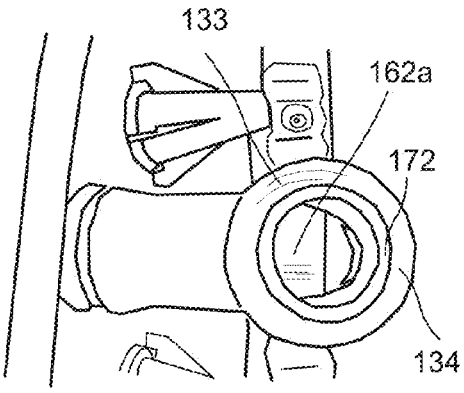
FIG. 20 is a side view of a valve in an open configuration.
Figure 21:
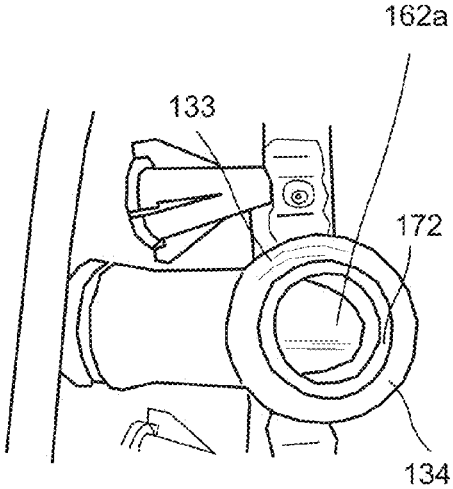
FIG. 21 is a side view of a valve in a closed configuration.

FIGS. 19 through 21 show various aspects of the structure associated with the bottom water feed connector 133 that attaches to the water port 135 in FIG. 7) in the spa shell. FIG. 19 shows a perspective view of the jet valve 130 in the module 127, including the O-ring 134, collar 164, positioning knob 168, anterior ridge 170, and end ridge 172. The O-ring 134 may be a double ring rubber ring that fits snugly around the water connector 133. Abutting the anterior ridge 170, the O-ring is prevented from sliding longitudinally toward the positioning knob 170 when the water connector 133 is placed within the water port 135. Abutting the end ridge 172, the O-ring is prevented from sliding off the water connector 133. The O-ring provides a sealed-tight fit between the water connector 133 and the water port.

FIGS. 20 and 21 show the base of the water connector 133, O-ring 134, end ridge 172, and extension rod 162*a*. In FIG. 20, the extension rod 162*a* is shown in an open position. In FIG. 21, the extension rod 162*a* is shown in a closed position. The extension rod 162*a*, and consequently water flow through the water connector 133, may be finely controlled and adjusted by rotating the positioning knob 168. Thus, the extension rod 162*a* may be completely open, completely closed, and any where in between, depending on the rotation of the positioning knob 168.

The location of the positioning knob 168 is beneficial, not only for being located near the extension rod 162*a*, but also for being located near the base of the module 127. The module 127 may often be placed along the sides of the spa and be targeted at a back region of the user. Thus, the base of the module 127 may often occur in the general area where the user naturally places his or her hands. Thus, whether it be a cold, icy morning or a dark and frigid night, the user need not reach out of the spa water to adjust the jet flow with the positioning knob 168. Thus, the valve and its placement enhances the comfort and ease of the user while providing fine tuning control at the same time.

Like the jet shields 123, the sides of the collar 164 are generally flush with the outer surface of the module 127, the collar 164 thus providing a generally continuous surface on the module 127.

Figure 22C:
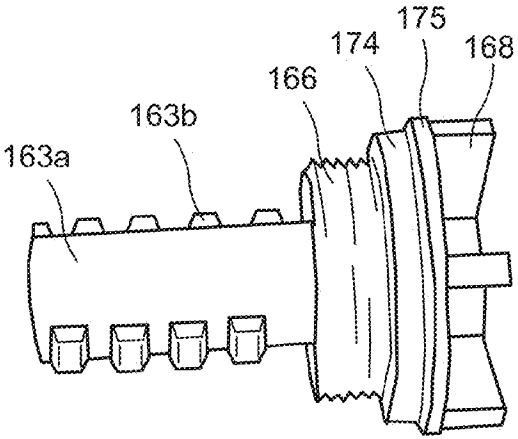
FIG. 22*c* is a side view of a positioning knob.
Figure 22B:
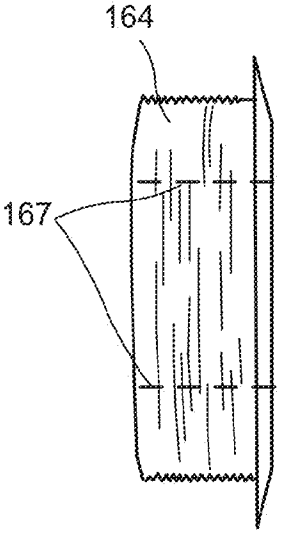
FIG. 22*b* is a side view of a collar.
Figure 22A:
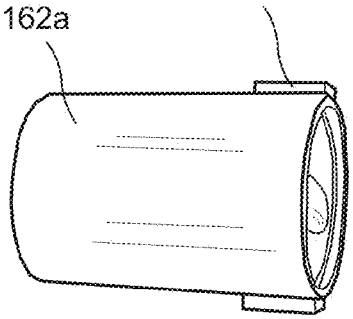
FIG. 22*a* is a side view of an extension rod.

FIGS. 22*a*, 22*b*, and 22*c* collectively create an exploded view of the jet valve including the positioning knob 168, a knob ridge 174, knob rim 175, a threaded ring 166, a beam 163*a*, beam ridges 163*b*, collar 164, slots 167, extension rod 162*a*, and rod ridges 162*b*.

The collar 164 includes an opening that fits around the knob ridge 174 and abuts against the knob rim 175. The interior surface of the collar 164 includes slots 167 as indicated by dashed lines. The slots 167 allow the rod ridges 162*b* on extension rod 162*a* to be slidably housed within the collar 164. The slots 167 act to prevent rotational movement of the extension rod 162*a* relative to the collar 164, while still allowing for longitudinal movement relative to the collar 164. The exterior of the collar 164 is threaded and may therefore be connected to the module 127 by a screw fit.

The positioning knob 168 includes a beam 163*a* with one or more rows of beam ridges 163*b*. For example, a pair of beam ridges 163*b* are shown. Beam 163*a* may be fitted into the opening of the extension rod 162*a*. The interior of the extension rod 162*a* is ridged. Consequently, the positioning knob 168 is held fixed by the collar 164 and module and so rotation of the positioning knob 168 causes the extension rod 162*a* to move longitudinally to and away from the positioning knob.

With the positioning knob 168 connected to the module 127, turning the positioning knob 168 moves the extension rod 162*a* longitudinally outward or inward, depending on the direction of the turn.

Figure 23A:
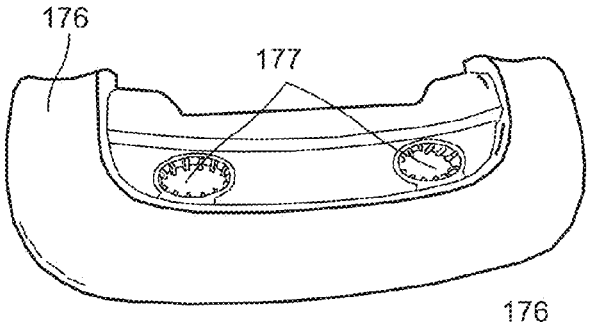
FIG. 23*a* is a perspective view of a cover with cover receivers.
Figure 23B:
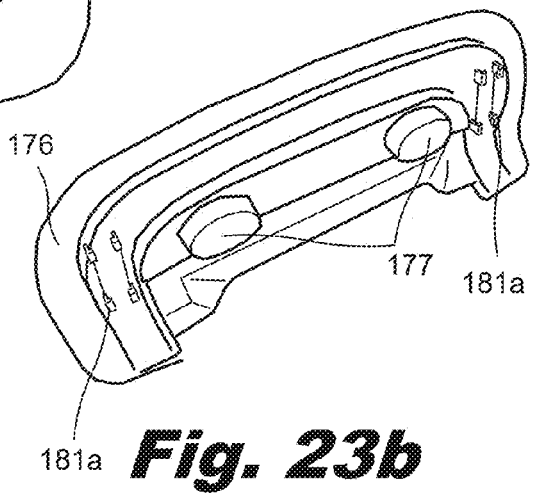
FIG. 23*b* is another perspective view of a cover with cover receivers.
Figure 25:
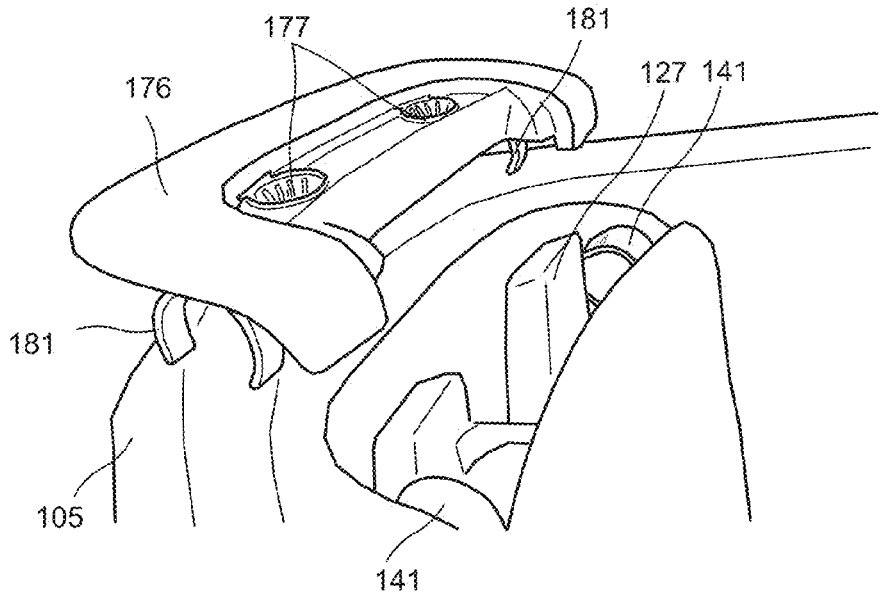
FIG. 25 is a perspective view of a cover.

Turning to FIGS. 23*a* 23*b*, and 25, a cover 176, cover receivers 177. Hook mounts 181*a* are provided for mounting hooks 181 shown in FIG. 25. The cover 176 may be placed over the module and clipped or connected to the shoulders 141 of the spa containment (not shown). Alternatively, the cover 176 may be connected by other common means, such as screws, bonding, adhesive, etc. The hooks 181 may prove useful in order to allow the cover 176 to quickly and easily be removed and then be re-attached. Removing the cover 176 may be necessary so that the module may be removed from the spa containment. The cover 176 may be advantageous because it protects the module and provides stability. Furthermore, the cover 176 provides a surface on which a user may put his weight rather than putting weight on the module. Also, the cover 176 provides an aesthetic surface that is generally continuous with the rest of the outer spa surface.

The cover receivers 177 include openings within the cover 176 that may be used to hold a pillow for the user. In FIG. 23*b*, the base of the cover 176 and cover receivers 177 are visible. As shown the cover receivers 177 extend below the cover to provide room for corresponding pillow inserts.

Figure 24A:
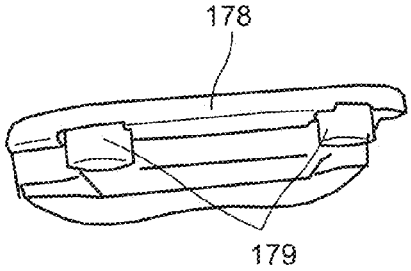
FIG. 24*a* is a perspective view of a cover with a pillow attached.
Figure 24B:
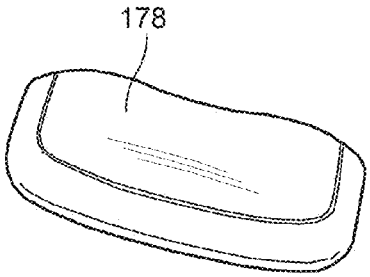
FIG. 24*b* is another perspective view of a cover with a pillow attached.

Turning to FIGS. 24*a* and 24*b*, various perspective views of a pillow 178 and pillow inserts 179 are shown. The pillow inserts 179 fit into the cover receivers 177. The pillow 179 may be made of rubber, silicone, or other flexible material to provide a comfortable resting surface for a user's neck. Other materials may also be used. Because the pillow 179 may be easily removed by pulling the pillow inserts 179 out of the cover receivers 177, other accessories or other pillows may be used in its stead. The pillow 179 has pillow inserts 179 that may be fit within cover receiving holes 177 and thus secure the pillow 179 to the cover. This is advantageous because it allows the pillow to be replaced as needed or as desired. It also allows the pillow to be removed when not in use or stored for a season when the spa is not being used.

FIG. 25 includes module 127, cover 176, cover receivers 177, spa containment 105, hooks 181, and shoulders 141 and 142. The cover 176 is shown being placed over a module to be connected to the spa containment 105 via shoulders 141. Such a connection may be advantageous because it requires mere pressure exerted from a user's hands and no tools.

Figure 26:
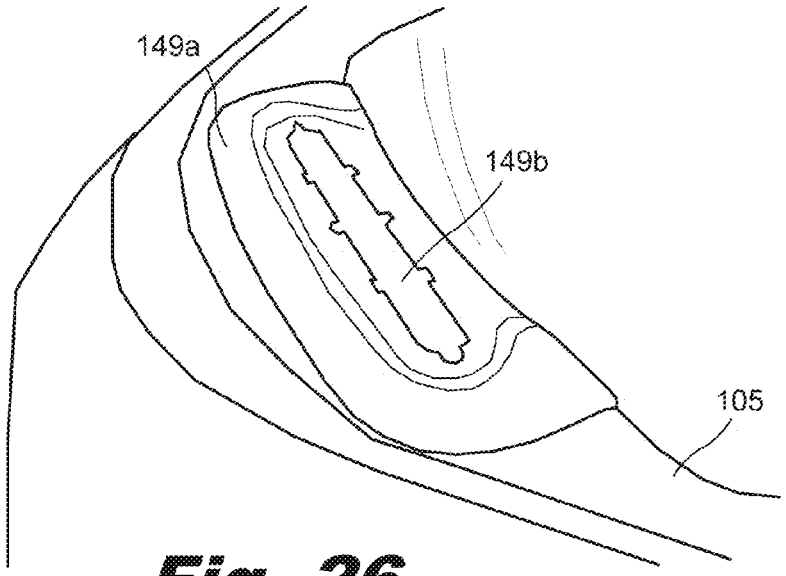
FIG. 26 is a perspective view of a cover attached to a spa.

The hooks 181 may include rounded sides or extended members that extend outwardly and that curve to generally conform to the curves of rounded shoulders 141. The sides may be rectangular, oval, triangular, and other shapes that are configured to attach to the shoulders 141 or other members of the hollow. The hooks 181 may comprise plastic, metal, and any number of materials that are suitable to clasp the cover to the spa. Furthermore, the material of the hooks 181 may be rigid or flexible. To attach the cover 176 to the spa, downward pressure is exerted on the cover 176 until the hooks 181 engage the shoulders 141. A similar procedure may be performed on alternate cover 149*a* in FIG. 26. Instead of hooks and shoulders as shown, alternate attachment means may include a number of other means, including latches, screws/bolts, and expansion fitting members. Other means that are known within the art may also be used. FIG. 26 shows the alternate cover 149*a* in an attached position, with the alternate cover 149*a* covering the module 127.

FIG. 26 includes alternate cover 149*a*, alternate cover opening 149*b*, and spa containment 105. Given an alternate cover opening 149*b* that comprises a rectangular, oblong, or other shaped slot opening, accessories other than the pillow 179 may be mounted.

Also, the alternate cover opening 149*b* may provide access for accessories to connect to the module, other spa equipment or even the spa itself. For example, an accessory may require a water supply and air supply. Providing such a supply could be achieved through a direct connection to the air or water chambers within the module or connecting tubing to the chambers. Other means of delivering water and air beneath the alternate cover 149*a* to an accessory is envisioned. The alternate cover 149*a* may have generally flat edges or edges that coincide with the edges of a spa so that the alternate cover 149*a* may lay generally flush with the edges of a spa.

Figure 27:
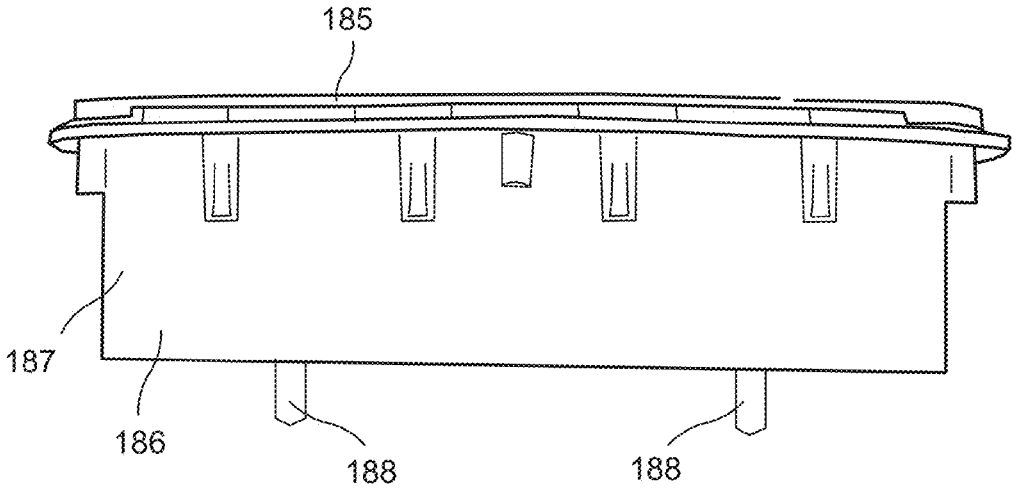
FIG. 27 is a cascading sheet accessory in a closed position.
Figure 28:
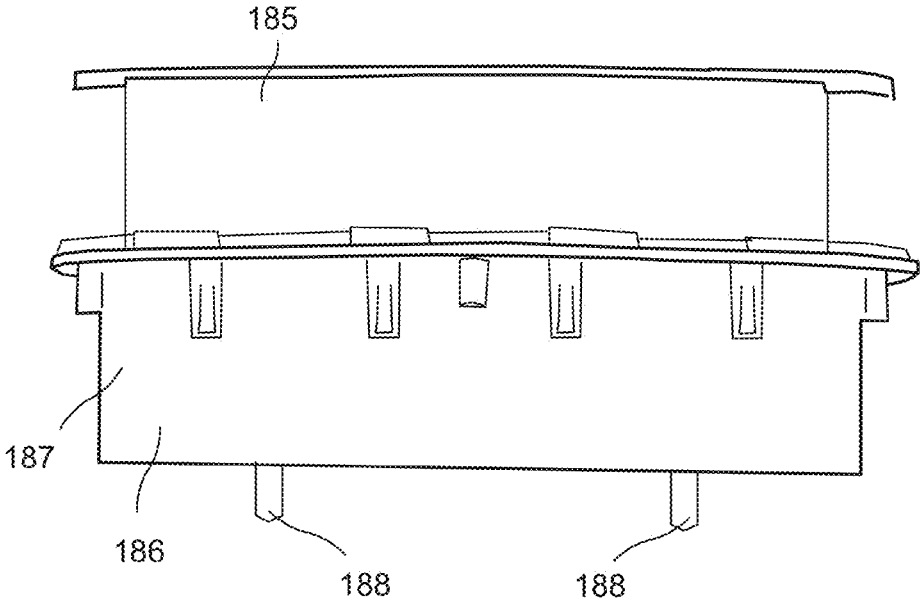
FIG. 28 is a cascading sheet accessory in an open position.

One accessory for the module 127, a cascading sheet accessory 187, is shown in FIGS. 27 and 28. The cascading sheet accessory 187 includes a raised platform 185, a platform shell 186, and shell inserts 188. The raised platform 185 fits within the platform shell 186 such that it may be raised and lowered within the platform shell 186. The raised platform 185 includes a hollowed space in which water may flow. At or near the top of the raised platform 185 is a slivered opening that spans the length of the raised platform 185. From this opening, a sheet of water may flow outward, creating a waterfall effect. Such an effect may be used to create the appearance of a waterfall in a spa. Also, the limitation of water height reaching only to the spa water level is overcome by the raised platform 185 making the neck region and other upper body regions accessible. Thus, the laminar flow may be soothing to a user's neck region.

To help raise the raised platform, the raised platform 185 may comprise lightweight plastic or other lightweight material. Also, the hollowed space inside the platform may be large, to create less density and thus less weight to raise. Water that flows through the platform is pressurized and pushes the raised platform 185 upward and out of the platform shell 186. The raised platform is prevented, however, from coming completely out of the platform shell 186, by a ridge, a latch, or a narrowed opening at the top of the platform shell 186. Embodiments include other means commonly found to prevent the platform shell from coming out completely.

FIG. 27 depicts the raised platform 185 in a closed position while FIG. 28 shows the raised platform 185 in a raised position. Note that embodiments include that the raised platform 185 may be completely encased within the platform shell 186. This is advantageous because the platform shell 186 and raised platform 185 may be covered with a cover, like the alternate cover 149*a* shown in FIG. 26. A covering may be desirable, for example, when the waterfall effect or neck massage is not in use. This also may be desirable to protect the raised platform 185 when not in use.

Furthermore, the platform shell 186 may be placed on top of the cover 176 and held into place with the shell inserts 188 being placed into the cover receiving holes 177. Embodiments also include, however, that the platform shell 186 be placed over the module 127 without the cover 176 underneath it. In effect, the platform shell may act as a cover for the module 127. Thus, the platform shell may protect the module 127 similar to the cover 176. Other advantages are also anticipated.

Figure 29A:
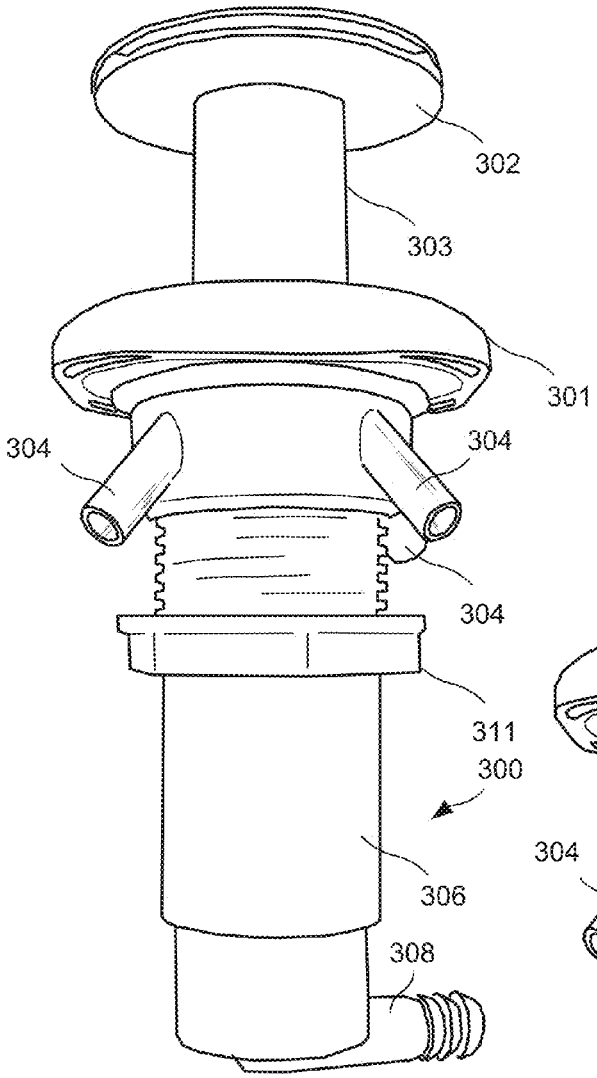
FIG. 29*a* is a neck jet accessory in an open position.
Figure 29B:
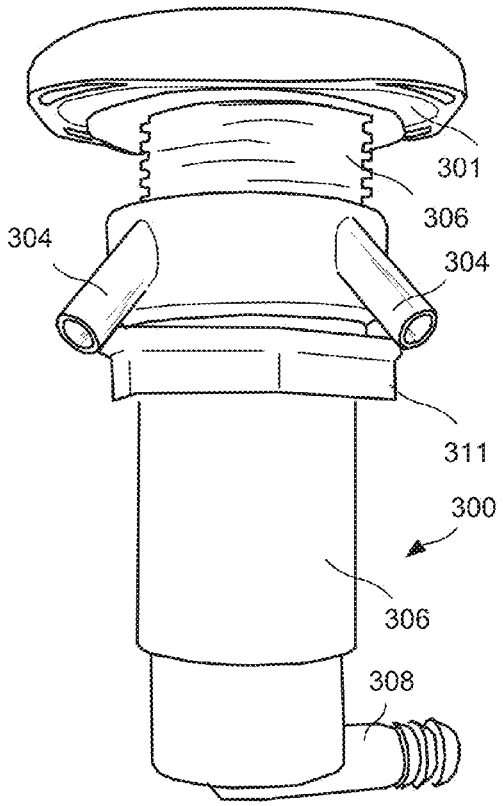
FIG. 29*b* is a neck jet accessory in a closed position.
Figure 30:
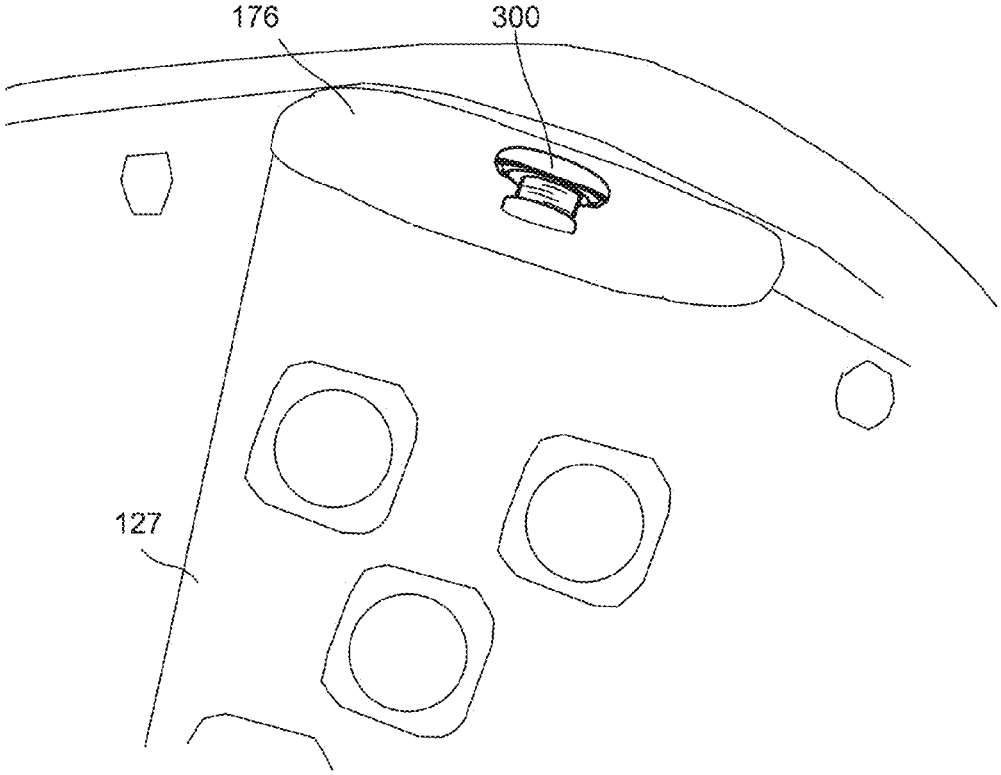
FIG. 30 is a neckjet accessory attached to a cover.

Another accessory, a water fountain accessory 300, is shown in FIGS. 29*a*, 29*b*, and 30. The water fountain accessory 300 includes topper 302, light conduits 304, neck body 306, and intake insert 308. Like the cascading sheet accessory, the water fountain accessory 300 provides water flow above the spa water line, creating a water fountain effect. Unlike the cascading sheet accessory 187, however, the water fountain accessory 300 may attach to any generally horizontal surface above the water level anywhere around the spa containment, such that water from the fountain flows into the containment. The fountain accessory 180 includes a neck body 306. To attach the water fountain accessory 300, the intake insert 308 may be used. The intake insert 308 may include an extended member that may have a push fit locking mechanism that engages with a water supply in the spa containment, module 127, or another accessory. Other means of engagement may also be used.

The topper 302 is generally disc shaped and fits upon a neck topper shaft 303 that may raise up and down within the neck body 306. Raising and lowering may be accomplished by pressurized water that flows into a hollow cavity within the neck body 306. When not pressurized, the topper 302 rests upon the topper base 303. When pressurized water fills up the hollow cavity and pushes the topper shaft and topper 302 out of the neck body and at a given height above the neck body 306, the topper 302 is stopped from being raised any farther. Water from the hollow cavity flows up the shaft into the topper and out of a slit outlet in the edge of the topper 302. Note that there may be one or more slit outlets.

Stopping may be accomplished by a ridge, a latch, or a narrowed opening at the top of the neck body 306. For example, a ridge on the topper 192 may be stopped by a ridge on or near the top of the neck body 306. For example, the ridge may be located on an interior edge or side of the neck body 306. Alternatively, a narrowed opening at the top of the neck body 306 may prevent a ridge on the topper. No ridge may be necessary with a narrowed opening, however. Other embodiments that prevent movement are also anticipated.

The neck body 306 is of a translucent material such that light can pass through the body. A light collar with light mounts or conduits 304, upon which can be mounted lights (not shown), surrounds the neck body and transmits lights into the translucent material into the hollow cavity and water in the cavity. The result is that the water stream emanating from the slit outlet is lighted along its length. The light may be white or of various colors. With more than one slit outlet, each slit outlet may have the same or different color scheme.

Lights and variations of light may further be emanated through light conduits 304. For example, blinking lights and different color patterns of light may be emanated. Also, the neck body and other other structures of the water fountain accessory 300 may be solid such that light may be limited to emanating from the light conduits 304. In summary, some structures may be translucent and other structures not be translucent. Also, a dimmer switch or other control may be used with the water fountain accessory to control the light, its patterns, and other variations.

FIG. 30 shows the water fountain accessory 300, the cover 176, and jet module 127. Embodiments may include attachment of the water fountain accessory 300 to the cover 176 and the water chamber 158 (see FIG. 9) of module 127 or another water supply. Embodiments further include, however, that the water fountain accessory 300 be located at locations around the spa containment where a water supply can be tapped into by the water fountain accessory 300. Holes may be drilled or walls may be preformed with patch holes ready to be punctured or cut out for the water fountain accessory 300. Referring also to FIGS. 29*a* and 29*b*, it is envisioned that the accessory may be mounted by removing the light conduits 304 and lock ring 311 and inserting the neck body 306 down through the hole from the top-side of the cover, and reattaching the light conduits 304 and lock nut 311 from the underside and screwing the lock nut up the neck body to secure the accessory. Thus mounted, the cover with hole is locked between the topper base and the light conduits 304.

Figure 32:
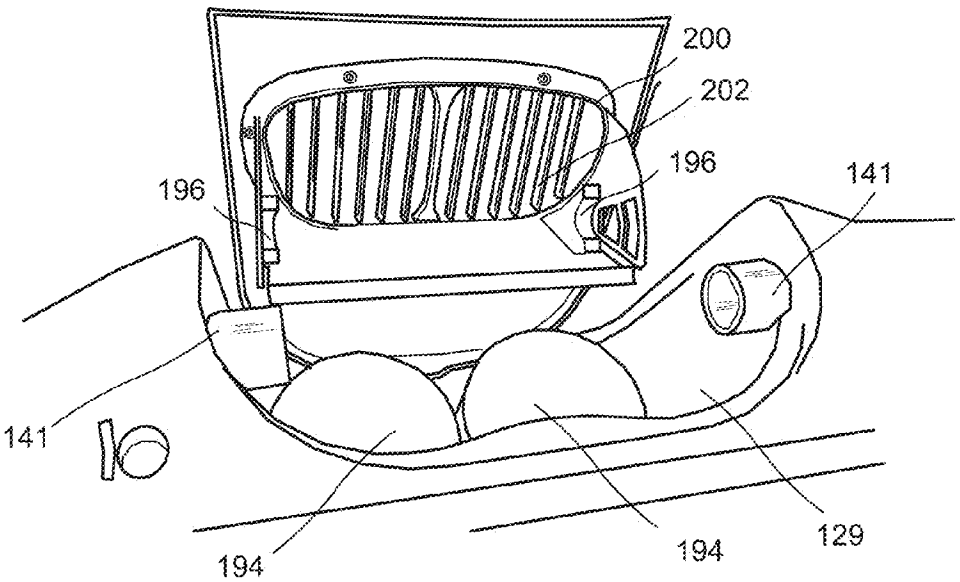
FIG. 32 is a perspective view of a pump intake filtration accessory that is attached to a hollow.
Figure 31:
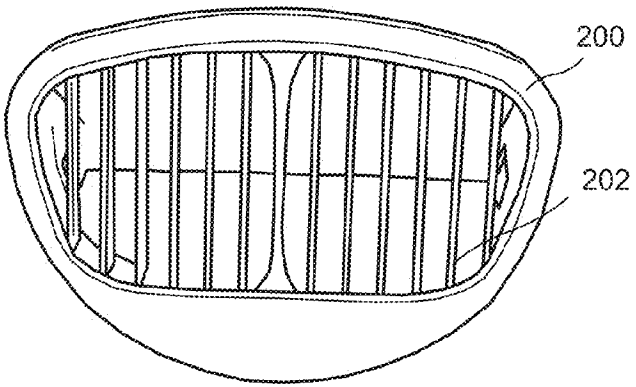
FIG. 31 is a perspective view of a pump intake filtration accessory.

FIGS. 31 and 32 show structure for withdrawing water from the containment and filtering water. FIG. 31 shows a grill 200 with water passages 202, which is designed to cover a water drain in the side of the containment 305. As shown in FIG. 32, the grill 200 may be mounted in a drain hole in a drain plate that is dimensioned similar to a jet plate. In a filter hollow are contained filter canisters 194, and any other suitable water treatment accessories. When the drain plate is in place covering the filter hollow, the appearance is similar and compatible with the appearance of a jet plate and module covering a hollow. Similar to the module/hollow covers described above, a cover (not shown) can be placed above the drain plate and be supported by shoulders 141. The grill 200 may include hooks 196 that may be used to connect to the shoulders 141. On top of the filtration sleeve 200 and hollow 129, the cover like the ones previously described may be attached. Thus, the filtration system may be protected and accessed while providing continuity with other covers that may be used in the spa.

Water for accessories in the cover or any other suitable location can be supplied by the water accessory outlet 157 in the manifold that communicates with the water chamber, which in FIG. 7 and FIG. 9 is shown between the air inlets. When manufactured, the water accessory outlet 157 may be constructed as a blind hole at the top of the water chamber. If a water supply is required, the blind hole may be punched out to provide access to the water chamber. Any suitable accessory is contemplated, including, for example, showers, fountains, or novelty water displays.

Other accessories are contemplated, including, for example, showers, fountains, or novelty water displays.

The grill 200 may include hooks 196 that may be used to connect to the shoulders 141. On top of the filtration sleeve 200 and hollow 129, a cover like the ones previously described may be attached. Thus, the filtration system may be protected and be accessed while providing continuity with other covers that may be used in the spa.

Figure 33:
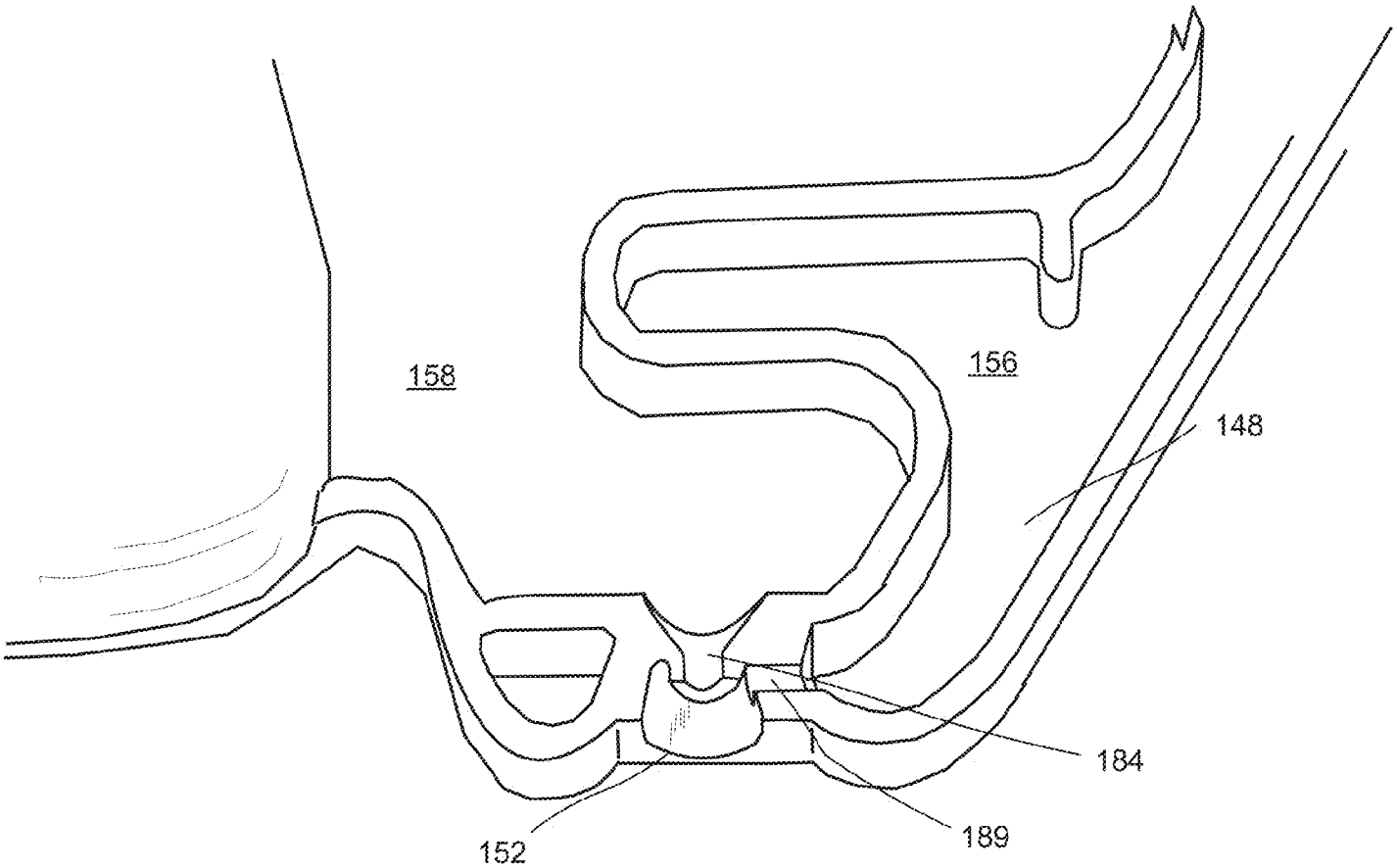
FIG. 33 is a front cutout view of a venturi drain.

Turning to FIG. 33, a close-up view of a venturi drain 152 located at the base of the manifold 148 is shown. The venturi drain 152 includes a converging water exit 184 communicating with water chamber 158 and side air passage 189, the side air passage 189 connected to air chamber 156. The venturi drain 152 may be useful when water remains in air chamber 156. For example, when a user leans against a jet or jet plate, water may be inadvertently forced to go back in to the air chamber 156.

The venturi drain 152 allows a pressure differential, or suction, created as water flows and accelerates through the water exit 184, to draw air or water from the air chamber 156 into the water stream through the side air passage 189. When the spa is turned off or on, the venturi drain 152 may function to quickly empty water in air chambers 158. When turned off, the air chamber 156 may then equalize its water level with water in the water chamber 158. In addition, the venturi drain 152 ensures water circulation in the hollow under the manifold 148, preventing stagnant regions in the hollow.

More than one venturi drain 152 may be used. As shown in FIG. 9, two venturi drains 152 are used, one on either side of the water connector 133 at the base of the manifold 148. Because the air chambers 156 on the sides may not intersect, having two venturi drains may be necessary to ensure proper drainage on both sides.

Drawing water out of the manifold 148 not only prevents residual buildup from stagnant water when the spa is not in use, but it also assists in the circulating water through the water chamber while the spa is in use. Because water pressure may vary, some water portions may not be circulated as much as other water portions. Therefore, drawing some water portions out of the manifold 148 may cause water to flow and thus improve circulation throughout the rest of the manifold 148.

Figure 34:
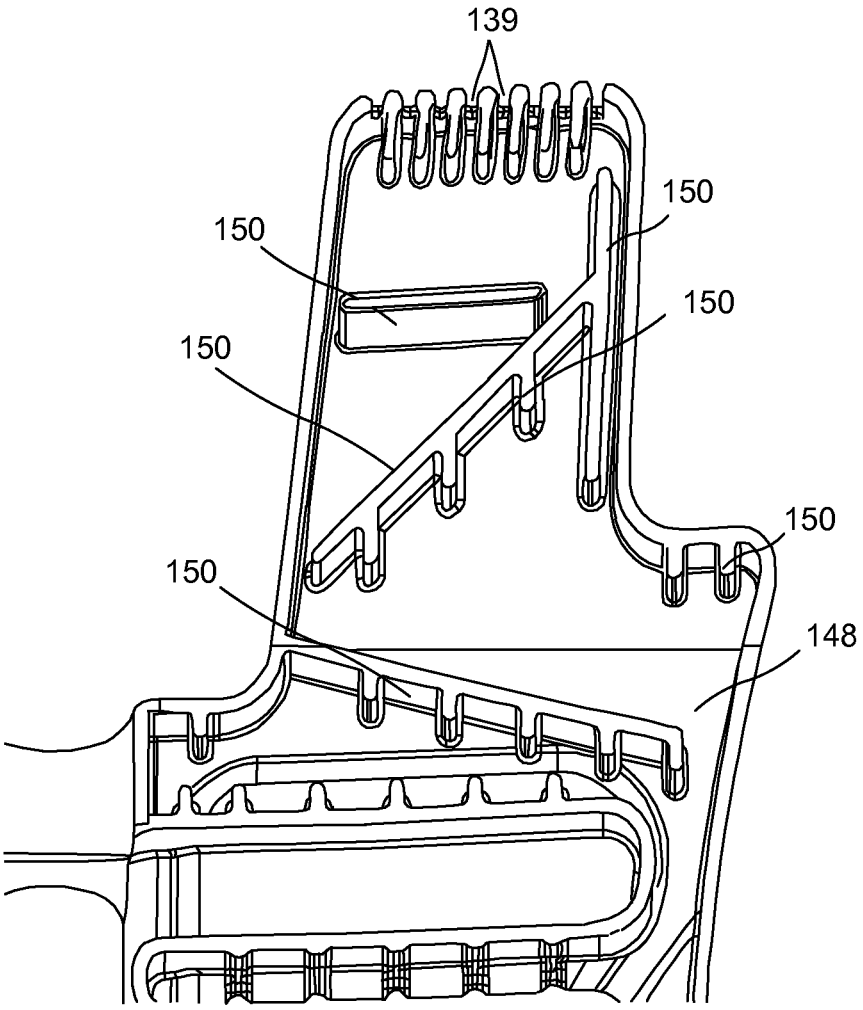
FIG. 34 is a front cutout view of an air baffle.

Turning to the top of the manifold 148, and as shown in FIG. 34, air ports 139 and air baffles 150 are shown in a close-up view. Air ports 139 may include one or more holes or openings that allow air to enter the manifold 148. Although the manifold 148 is covered by a cover, coverings may not be sealed so as to provide an airtight space over the holes or openings. Therefore, ambient air from surroundings may be used to supply air to the manifold 148. Also, air may be supplied by an air pump or other air supply. Air from surroundings may be desirable because the air near the spa may be warmer than air that is supplied by an air pump or other air supply. Thus, the air from the surroundings, being warm, may not have a cooling effect on the spa water. This may allow the spa to be more energy efficient.

Air baffles comprise interior walls within the manifold 148 that divert and shield the passage of air as it flows into the manifold 148. As shown, one or more air baffles may consist of an interior wall within the manifold 148. The air baffle 150 may extend from a side wall of the manifold and be angled relative to that side wall. Also, air baffles may have outshoot baffles, or subwalls that extend from interior walls. Embodiments include that the air baffles be perpendicular to the wall. Also, the air baffles 150 may be jagged or have curvature. Instead of each air baffle extending from a side wall, passage of air may be controlled by one air baffle that angles one way and then angles another way to provide a path for air. Embodiments further include multiple channels provided by the air baffles. For example, each air port 139 may have its own set of one or more baffles, and thus, its own pathway of air into the manifold 148. If multiple pathways are made by air baffles, each pathway may include its own set of interior air baffles. Further embellishments are envisioned for air pathways that would be commonly known.

Using air baffles 150, air flow may be streamed smoothly along a path. This is beneficial because it prevents directionless movement that would otherwise cause noise and vibration to the manifold 148. Quiet movement of air promotes a more peaceful and enjoyable experience for the spa user. Therefore, air baffles benefit both the spa stability and user experience.

Turning to FIG. 35, a series of modules 190, 191, 192, and 193 are shown. Each module depicts a different configuration of jets with variables that include number of jets, jet diameter, jet shape, and jet position. For example, FIG. 35*a* shows a module with six jets, while FIG. 35B shows eight jets, FIG. 35C shows six jets, and FIG. 35D shows only four jets. The number of jets may vary, having more than eight jets or as little as only one jet. Also, the position of the jets may vary. For example, the jets may be placed only on the upper half of the module. They may be placed near the sides of the module as shown in FIG. 35B and they can be placed in a checkerboard pattern as shown in FIG. 35*a*. Other arrangements are envisioned.

Figure 35A:
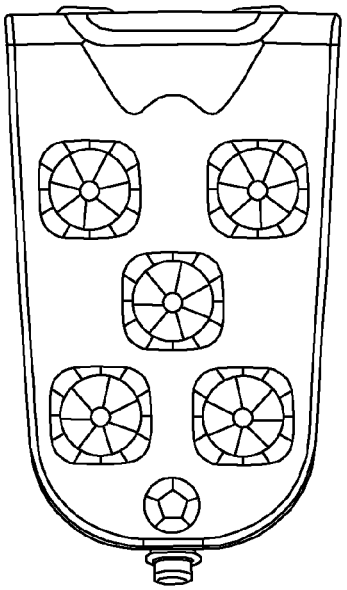
FIG. 35*a* is a configuration of a jet module.
Figure 35B:
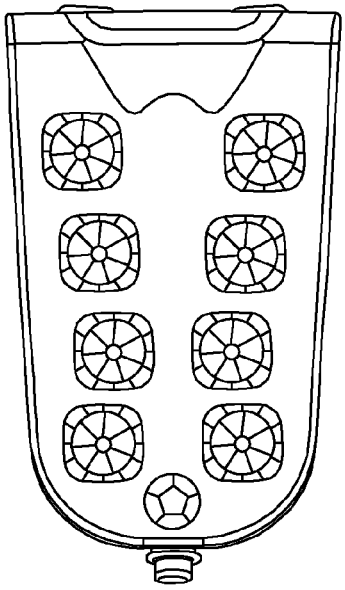
FIG. 35*b* is another configuration of a jet module.
Figure 35C:
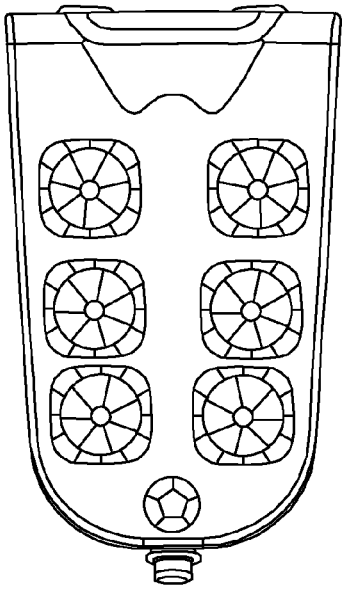
FIG. 35*c* is another configuration of a jet module.

The jet diameter may also vary. FIG. 35A and FIG. 35C show large diameter jets, while FIG. 35B shows smaller diameter jets. Although not shown, a single module may have jets with diameters both large and small. Fittings are envisioned to allow the larger diameter jets to be interchangeable with smaller diameter jets. Thus, the user may change jets with differing diameters as needed or desired.

Figure 35D:
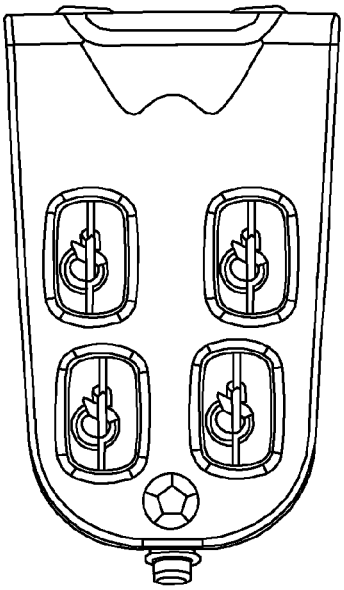
FIG. 35*d* is another configuration of a jet module.

FIG. 35D shows a set of rectangular jets. The nature of the shape of the jet may changed to allow a different type of jet flow. Other shapes, such as oval or triangular, may be used.

With variables in shape, size, number, and position, the user can tailor his or her spa experience as needed or desired. A user with a spinal injury may focus on the spinal region while a user who wants a full back massage may incorporate a copious number of jets sprinkled all over the module. Also, each module in a spa may be singular from all the other modules to suit the individual tastes of different users as well as the different needs and desires of a single user. By providing different jet experiences, the spa environment is more likely to be enjoyable to family, friends, and gatherings in general. Also, the spa environment is more likely to suit a single user with multiple needs, target regions, or desires.

Figure 36:
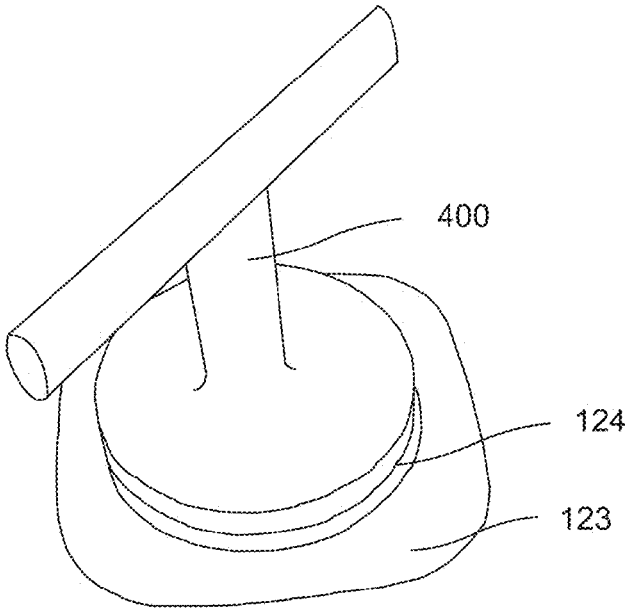
FIG. 36 depicts a locking tool.

Turning to FIG. 36, a locking tool 400, a jet cover 124, and jet shield 123 are shown. The locking tool 400 may be used to twist or screw the jet cover to the jet, and thus secure the jet shield 123 sandwiched between the jet cover 124 on one side, and jet 119 and jet plate 117 (see FIG. 17) on the other side. The locking tool 400 may include a handle or other means for gripping, twisting, lifting and lowering the locking tool 400. As depicted in FIG. 36, the locking tool fits over the jet cover 124 and may be fitted such that a facing of the locking tool 400 matches or otherwise aligns with a facing of the jet cover 124. Alignment may further include indentations, holes, magnetic structures, or other alignment means, such that a twist of the locking tool translates force, rotational movement, lifting, and lowering of the jet cover 124. In this manner, the jet cover 124 may be handled, and specifically, locked and unlocked, depending on clockwise or counter-clockwise rotation being applied.

Figure 37:
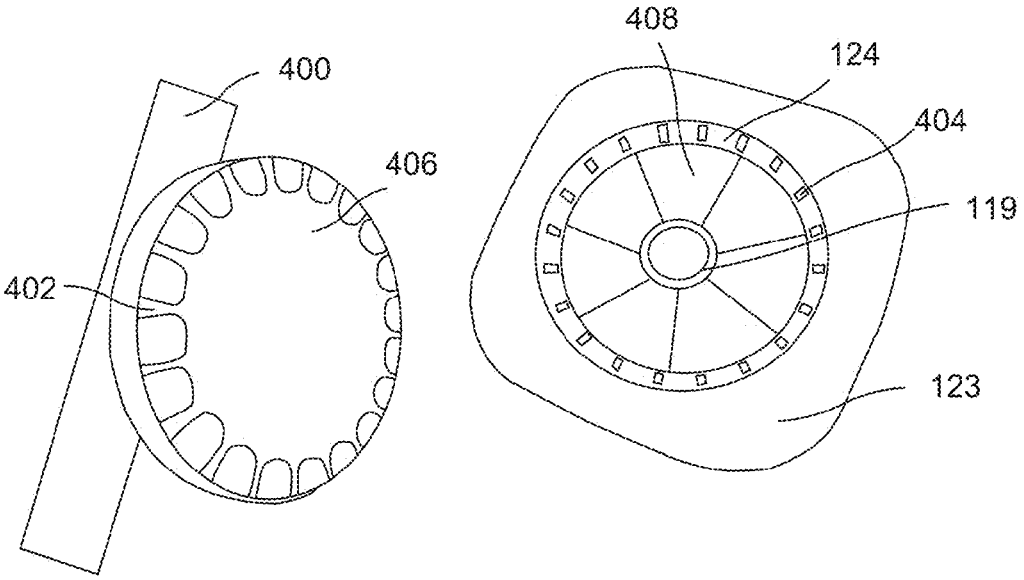
FIG. 37 the base of the locking tool and jet.

Embodiments that include exemplary alignment means are shown in FIG. 37. Included is a perspective view comprising locking tool 400, teeth 402, jet cover 124, jet 119, jet shield 123, and grooves 404. On locking tool 400, teeth 402 may be located at or near peripheral edges of facing. Rounded facing as shown includes teeth 402 located along the periphery with teeth 402 protruding outward, with edges drawn radially inward. Edges may be curved or slanted, pointed, etc.

Embodiments include that a muffler be used to reduce noise and vibrations. With reference to FIGS. 38-43, various views of muffler 500 are shown. Muffler 500 may include chambers 502 and 504, open chamber 506, end channel 512, and flange 514, as shown. Muffler 500 may be used in addition to, or as an alternative to, air baffles 150 (air baffles referenced in FIG. 9).

Figure 38:
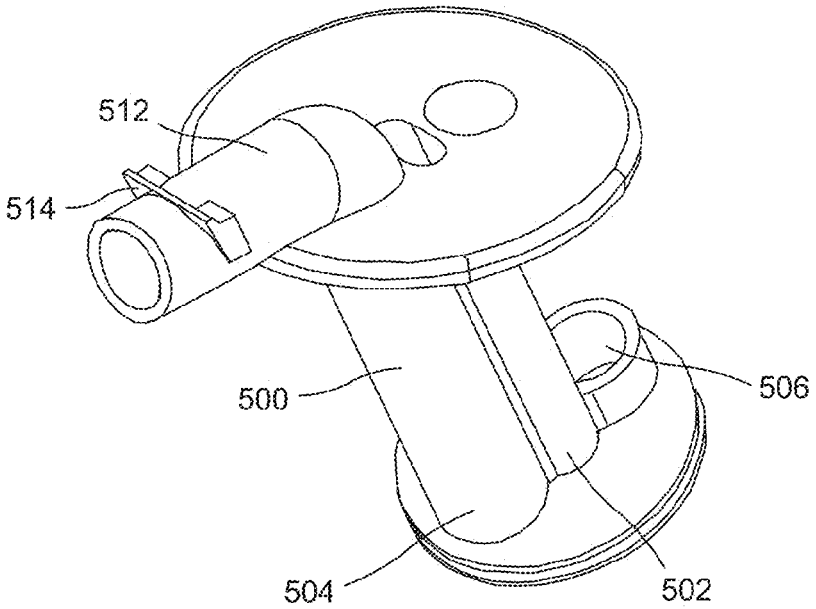
FIG. 38 depicts a perspective view of a muffler.
Figure 39:
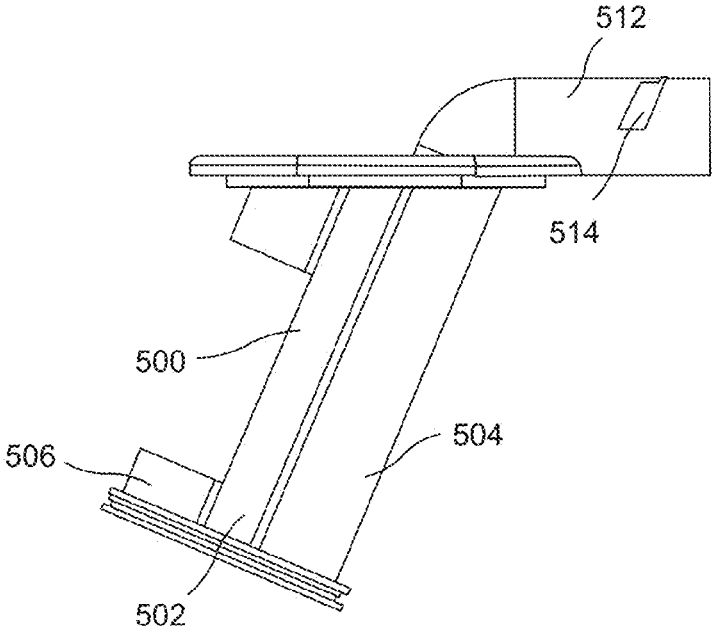
FIG. 39 depicts a side view of a muffler.

Turning to FIG. 38, a perspective view of muffler 500, flange 514, end channel 512, and holes 502, 504, and 506 are shown. FIG. 39 shows a side view of muffler 500. As shown in both figures, the muffler 500 may comprise a single part that has a right angle bend, or end channel 512, to direct air from the jet plate into chambers 502, 504 and 506, and then out of the jet. In the process, the muffler 500 serves to remove, reduce, and eliminate harmonic frequencies from sources such as turbulence. As a result, users may enjoy a noiseless, whistle-free spa system.

Flange 514 may lay flush with a portion of the manifold, namely, recess 508 (not shown), as will be described in greater detail later.

Figure 40:
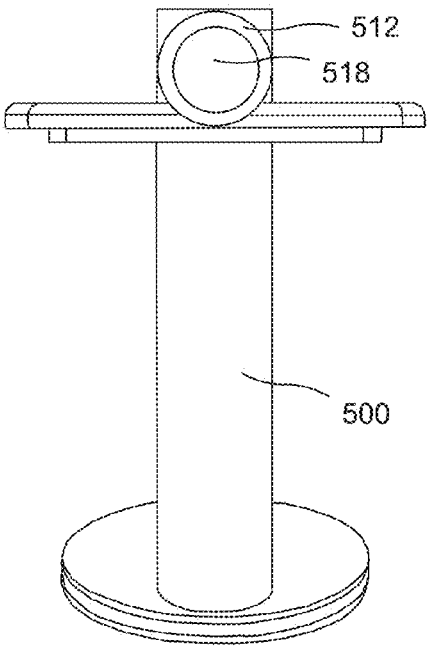
FIG. 40 depicts a front view of a muffler.
Figure 41:
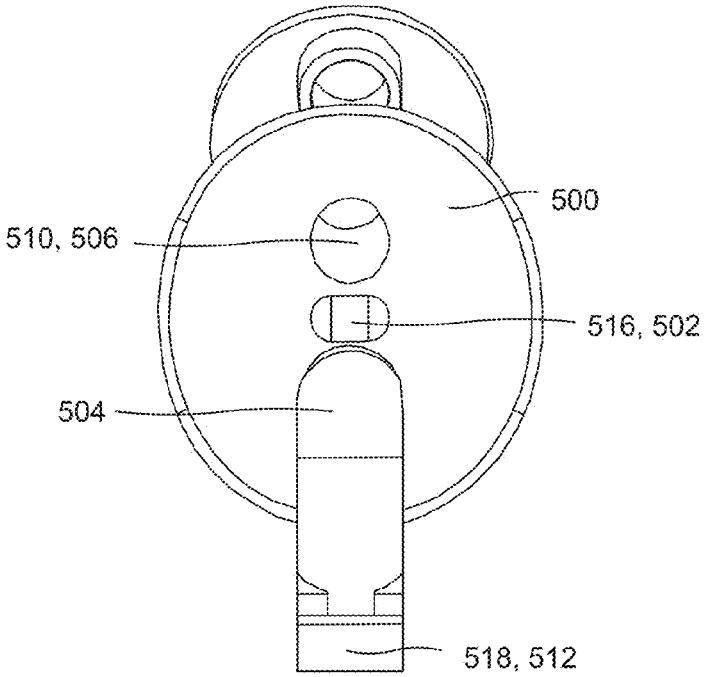
FIG. 41 depicts an end view of a muffler.

Turning to FIG. 40, a front view of muffler 500 is shown facing the hole 518 of end channel 512. FIG. 41 shows an end view of muffler 500 where hole 518 of end channel 512 is facing downward. Hole 516 of chamber 502 and hole 510 of open chamber 506 are also shown in FIG. 41. Diameters may vary. Note that hole 516 is shown as oblong while hole 518 of end channel 512 of chamber 504 is shown as circular. Other shapes and configurations are anticipated. Factors to consider for shapes and lengths of the muffler 500 may center on removing and eliminating noise and vibration. Other considerations may also be included.

Figure 42:
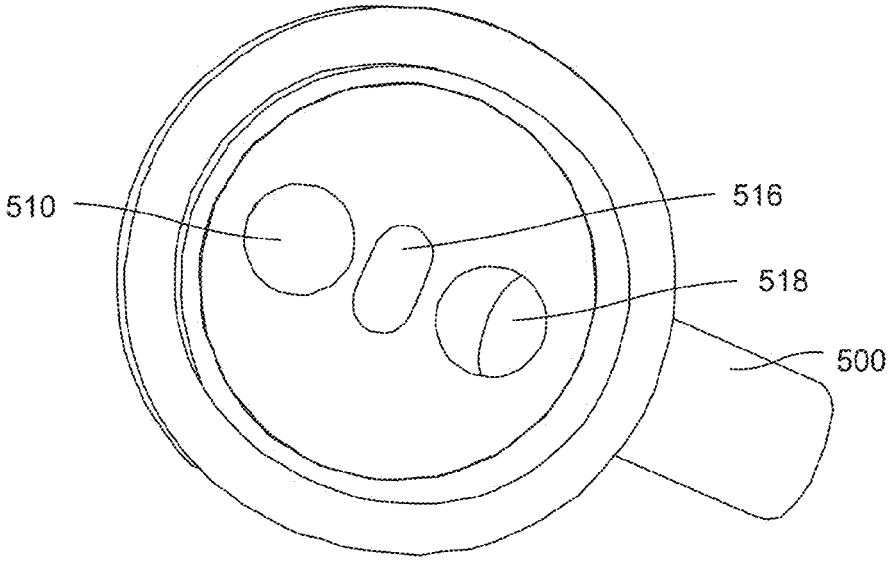
FIG. 42 depicts an end view of a muffler.
Figure 43:
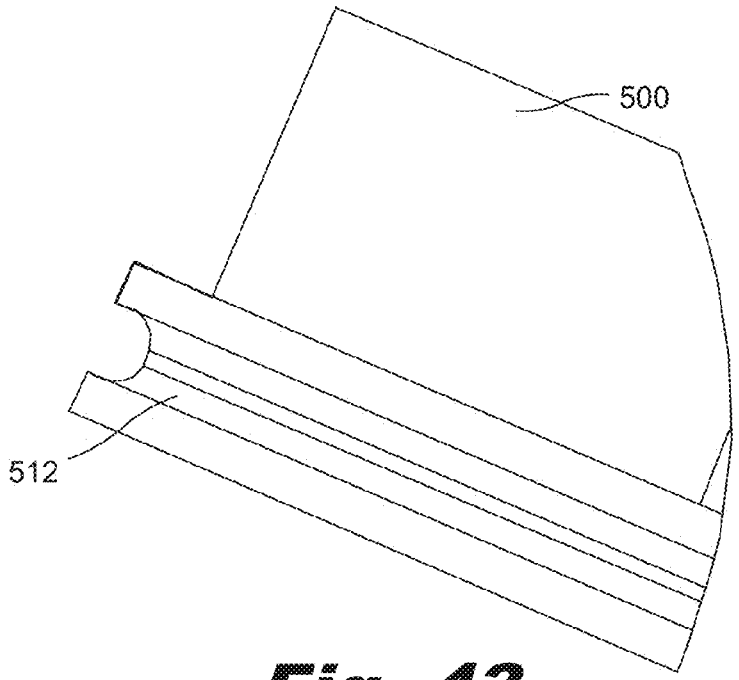
FIG. 43 depicts a cutout view of a muffler.

Turning to FIG. 42, muffler 500 with frontal view of holes 510, 516, and 518 is shown. Note that the number of holes may vary. Also note that the form and configuration of channels may vary. A cutout view of end channel 512 in muffler 500 is shown in FIG. 43.

Figure 44:
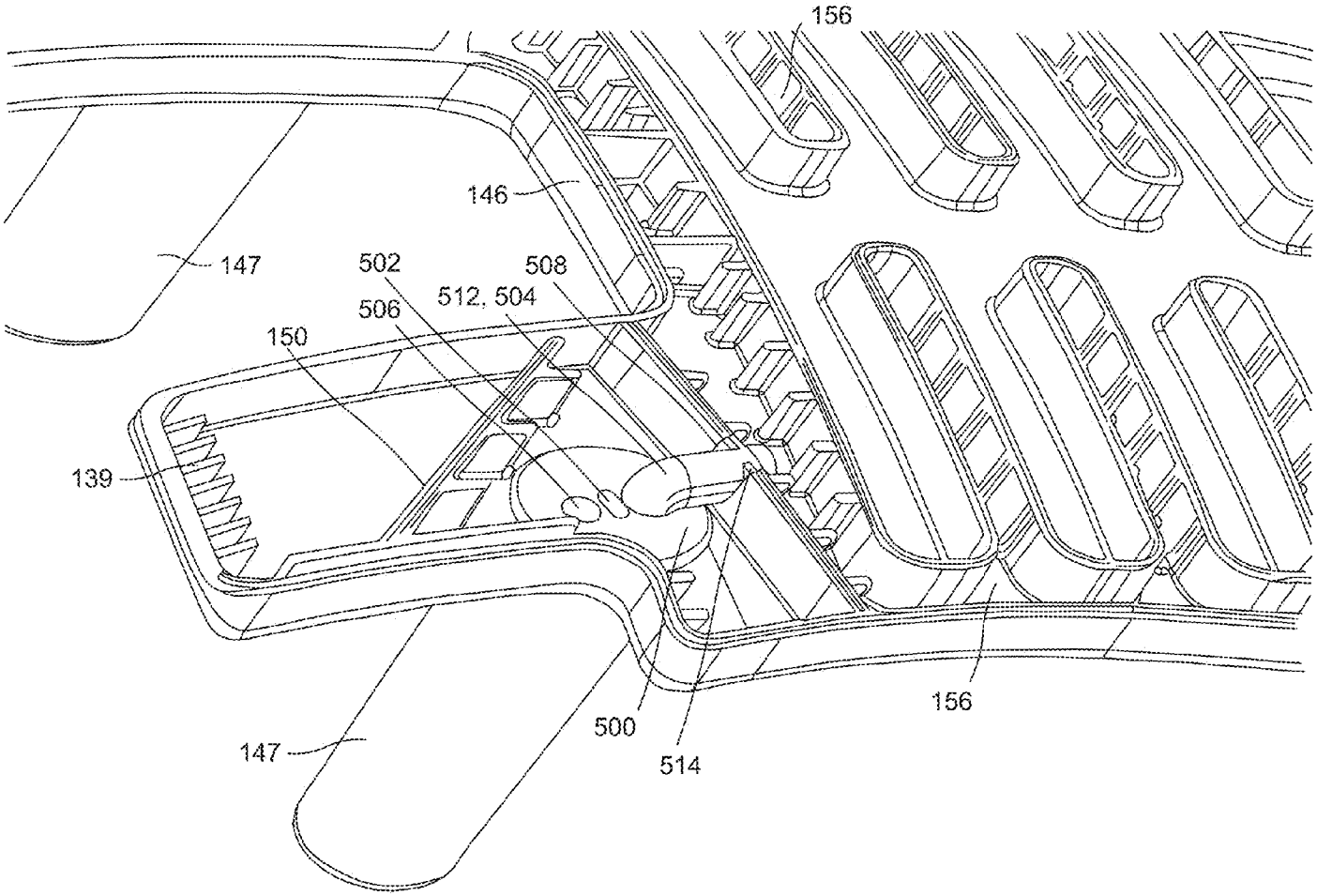
FIG. 44 depicts a perspective view of a muffler attached to a top section.

Turning to FIG. 44, a perspective view is shown of top section 146, air port 139, air chambers 156, abutment member 147, air baffle 150, recess 508, muffler 500, end channel 512 of chamber 504, and flange 514. In assembling the muffler 500, the end channel 512 is inserted into recess 508, a hollowed portion along air baffle 150, as shown. The location of the recess 508 may be aligned with the opening of the abutment member 147, however, other positions and alignments are anticipated.

In conjunction with the recess 508 of one or more air baffles 150, a hollowed portion may also be present in one or more walls of the side-by-side array of slanted chambers. Also, if no air baffles 150 are used, the muffler may instead be inserted into of one or more recesses of one or more walls of the side-by-side array of slanted chambers.

As shown in FIG. 44, the right and left sides comprising air chambers 156 may be closed off from each other. A muffler 500 may therefore be placed on each left and right side. Air muffler 500 is shown. As the jets draw air, the flow of air may come through air ports 139 on the left and right sides; into respective air chambers; around air baffles 150; down into muffler chambers 502 and 506; into space of hollowed abutment member 147; out through end channel 512 of chamber 504; and then through respective air chambers 156 and jets. Note that the connected abutment member 147 may have a varied amount of hollowed space in which air may expand and flow.

Having an air chamber is useful because it allows a place for air to go, expand, and move around. Having separate air chambers is useful because it allows a separate space and size for air to go and expand. By having a different size and opening among the chambers, the air is dampened and smoothed. Embodiments include designs for a range of air flow in the jet pack.

Whistling may arise from within the jet module; the muffler thus effectively removes unwanted noise and quiets the air flow.

Figure 45:
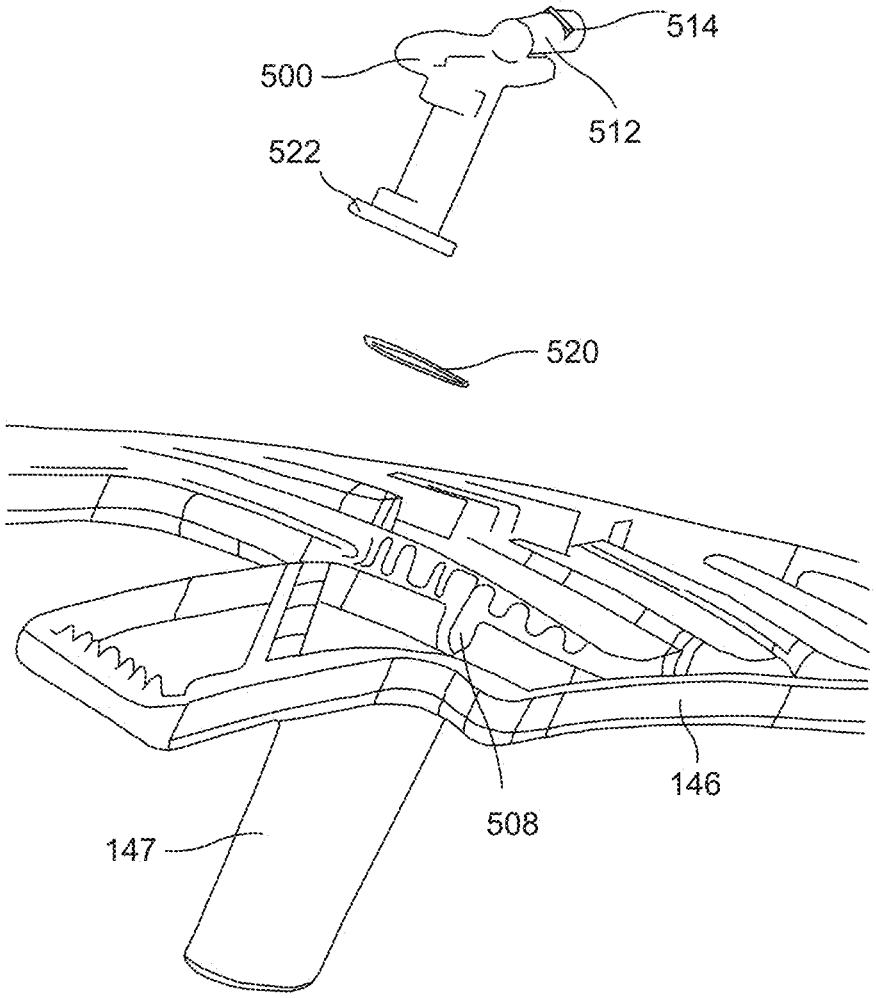
FIG. 45 depicts an extruded view of a muffler and top section.

Turning to FIG. 45, an extruded view of top section 146, muffler 500, end channel 512, O-ring end 522, flange 514, O-ring 520, and recess 508 is shown. In assembling the muffler 500, an O-ring 520 may be placed on the O-ring end 522 for a friction seal with the abutment member 147. The O-ring provides a tight friction seal for the fastened O-ring end 522 such that air must go through the muffler 500. Note that if air were to go around the muffler 500, the air would cause further harmonics, similar to a situation with a muffler in a car and a hole next to the muffler.

For the other end, the end channel 512 may be placed within the recess 508 and glued or otherwise secured. For example, a friction fit may be used in conjunction with glue or used alternatively to glue.

To install the muffler, steps may include placing the O-ring 520 around O-ring end 522. Glue may be placed around the flange 514, and the end channel 512 may be inserted into the recess 508. In this manner, the top of flange 514 may be sealed to the top section 146. The O-ring end 522 may be secured with a friction fit within the opening of abutment member 147.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. An interchangeable jet module comprising:

at least one jet;

a manifold with a mounting surface for mounting a base portion of the at least one jet;

a jet plate with a mounting surface for mounting a top portion of the at least one jet;

an array of air and water chambers underlying the manifold mounting surface, wherein the air chambers are configured to receive air from an air supply and communicate the air to the at least one jet, wherein the water chambers are configured to receive water from a water supply and communicate the water to the at least one jet, and wherein the at least one jet communicates air and water to an external environment, the array of air and water chambers being arrayed side-by-side to each other in a cross-sectional plane generally parallel to and underlying the manifold mounting surface, the array configured to allow multiple mounting locations on the manifold mounting surface wherever the underlying side-by-side water and air chambers are capable of being accessed by spaced air and water intakes on the at least one jet.

2. The interchangeable jet module in claim 1 wherein the manifold comprises:

a top section with a first set of ridges and a bottom section with a second set of ridges;

wherein the top section is attached to the bottom section, and wherein the first set of ridges are aligned with the second set of ridges to form the array of air and water chambers.

3. The interchangeable jet module in claim 1 wherein the manifold comprises:

a top section with a set of ridges and a bottom section;

wherein the top section is attached to the bottom section, and wherein the set of ridges are attached to the bottom section to form the array of air and water chambers.

4. The interchangeable jet module in claim 1, further comprising:

a conduit, a valve having a variable position within the conduit, the position of the valve defining a size of an opening of the conduit; and an adjustment control that controls the position of the valve, wherein a selected position is not affected by the water flowing through the conduit.

5. The interchangeable jet module in claim 1, further comprising:

a baffled passageway within the manifold that includes one or more walls in an airflow path such that the air from the air supply is directed to the array of air chambers by the one or more walls as the air flows within the manifold.

6. The interchangeable jet module in claim 1, further comprising:

a venturi passageway within the manifold that includes a water passage that communicates with the water chambers and an air passage that communicates with the air chambers, wherein water flow through the water passage draws air or water from the air chambers and into the water passage, the water passage communicating to the external environment.

7. The interchangeable jet module in claim 1, further comprising:

a water connector with an opening and dimensions that fit over a water port of a bathing structure, the water port receiving water from the water supply, such that when the manifold is an installed position within the bathing structure, the water connector is disposed to receive water from the water port; and a locking structure with structure such that a first single operation holds the jet module in an installed position in the bathing structure with the water connector and water port connected to provide water from the water supply, the locking structure further allowing the jet module to be released from the bathing structure with a second single operation.

8. The interchangeable jet module in claim 1, wherein the at least one jet comprises;

a jet wing that includes a hollowed member that extends radially outward from the base portion of the at least one jet;

a jet air intake insert that extends downward from an end of the jet wing and that includes an opening for receiving air into the at least one jet; and a jet water intake that includes an opening at the base portion of the at least one jet and that receives water into the at least one jet.

9. The interchangeable jet module of claim 8, wherein the jet water intake is configured to connect to the water chambers, and the jet air intake is configured to connect to the air chambers, the jet wing configured to pivot by axial rotation to allow the jet air intake to be positioned for connection with the air chambers.

10. The interchangeable jet module of claim 9, wherein the jet wing is capable of being extended to lengthen the jet wing.

11. The jet of claim 10, wherein the jet wing includes an inner hollow member contained within the interior of the hollowed member that is capable of being extended to lengthen the jet wing.

12. The interchangeable jet module of claim 1, further comprising:

a jet shield that covers the top portion of the at least one jet and that is structured to provide a generally smooth and continuous resting surface to a user; and a jet cover that secures the jet shield to the jet plate.

13. The interchangeable jet module of claim 1, further comprising a muffler with one or more chambers, wherein at least one chamber communicates air to the air chambers of the jet module.

14. The interchangeable jet module of claim 1, further comprising:

a cover placed over the interchangeable jet module.

15. The interchangeable jet module of claim 14, further comprising pillow inserts mounted to the cover.

16. The interchangeable jet module of claim 1, further comprising: a cover with a slotted opening that is configured to mount accessories.

17. The interchangeable jet module of claim 16, wherein the cover further comprises:

a cascading sheet accessory that includes a raised platform that fits within a platform shell, the raised platform being raised and lowered by water pressure within the platform shell; and a a slivered opening along the length of the raised platform with a width allowing a sheet of water to flow outward and create a waterfall effect.

18. The interchangeable jet module of claim 16, wherein the cover further comprises:

a water fountain accessory that includes a generally disc-shaped top and a shaft, the disc-shaped top and shaft being raised and lowered within a neck body by pressurized water being exerted on the disc-shaped top and shaft, the disc-shaped top having a slit for the release of water; and the water fountain accessory further including light conduits that extend outward from the neck body and are lighted along their length.

19. The interchangeable jet module of claim 18, wherein attachment of the water fountain accessory is achieved by a neck body insert that is configured to attach to water chambers or water supplies that are located around a water containment.

* * * * *